US006610338B2

(12) United States Patent
Tang

(10) Patent No.: US 6,610,338 B2
(45) Date of Patent: Aug. 26, 2003

(54) EASY TEARING BAGS AND PACKAGING MATERIAL

(75) Inventor: Luen Sing Tang, New Territories (HK)

(73) Assignee: Teckson International Limited (BS)

( * ) Notice: Subject to any disclaimer, the term of this patent is extended or adjusted under 35 U.S.C. 154(b) by 102 days.

(21) Appl. No.: 09/224,056

(22) Filed: Dec. 31, 1998

(65) Prior Publication Data

US 2002/0001645 A1 Jan. 3, 2002

(30) Foreign Application Priority Data

Jan. 5, 1998 (GB) ..... 9800118
Sep. 7, 1998 (GB) ..... 9819497

(51) Int. Cl.[7] ..... B65D 27/32; B65D 27/34; B65D 75/58

(52) U.S. Cl. ..... 426/115; 426/123; 426/127; 383/207; 383/208

(58) Field of Search ..... 383/109, 207, 383/208, 209, 100, 101; 426/106, 123, 127, 122, 118, 113, 111, 115, 410, 412, 413, 107

(56) References Cited

U.S. PATENT DOCUMENTS

| | | | | | |
|---|---|---|---|---|---|
| 3,083,876 | A | * | 4/1963 | Schneider et al. | 383/208 |
| 3,520,470 | A | | 7/1970 | Korn et al. | |
| 3,524,582 | A | | 8/1970 | Buttery | |
| 4,139,643 | A | | 2/1979 | Hix et al. | 422/122 |
| 4,353,498 | A | | 10/1982 | Scarberry et al. | 229/69 |
| 4,491,245 | A | | 1/1985 | Jamison | |
| 4,733,817 | A | * | 3/1988 | Makowka | 229/69 |
| 4,744,466 | A | | 5/1988 | Hall | |
| 4,793,121 | A | | 12/1988 | Jamison | |
| 4,903,841 | A | | 2/1990 | Ohsima et al. | |
| 4,935,283 | A | | 6/1990 | Jamison | |
| 5,061,500 | A | | 10/1991 | Mendenhall | 426/118 |
| 5,312,189 | A | * | 5/1994 | Aeschbach et al. | 383/207 |
| 5,413,412 | A | | 5/1995 | Odabashian | |
| 552,202 | A | * | 9/1996 | May | 428/43 |
| 5,552,202 | A | | 9/1996 | May | |

FOREIGN PATENT DOCUMENTS

| | | |
|---|---|---|
| FR | 2577896 | 8/1986 |
| GB | 777079 | 6/1957 |
| GB | 850457 | 10/1960 |
| GB | 1147846 | 4/1969 |
| GB | 1328353 | 8/1973 |
| GB | 1355036 | 5/1974 |
| GB | 2169874 A | 7/1986 |
| JP | 60115887 | 8/1985 |
| JP | 173143 | 5/1989 |
| JP | 1294446 | 11/1989 |
| JP | 259144 | 4/1990 |
| JP | 293240 | 7/1990 |
| JP | 5278750 | 10/1993 |
| JP | 10017012 | 1/1998 |
| JP | 11310278 | 11/1999 |
| WO | 9816382 | 4/1998 |

* cited by examiner

*Primary Examiner*—Nina Bhat
(74) *Attorney, Agent, or Firm*—Ostrolenk, Faber, Gerb & Soffen, LLP

(57) ABSTRACT

A multi layered packaging material (10) comprises a first inner layer C and a second outer layer A. The inner layer has a line of weakness 34 extending there along while the second outer layer A is substantially intact along the line of weakness. In the packaging material 10, the line of weakness is formed by two pieces of material $C_1$, $C_2$ with their edges in substantial abutment, the abutted edges creating the line of weakness. Bags 20, 30, 40, 60, 70, 80, 90, 100, 130, 140, 150 may be formed from the packaging material. However, the bags so formed are not limited to having the line of weakness created by abutting edges in the inner layer C.

60 Claims, 18 Drawing Sheets

C1
C2
A

P
AC 24
22
20

FIG. 9(a)
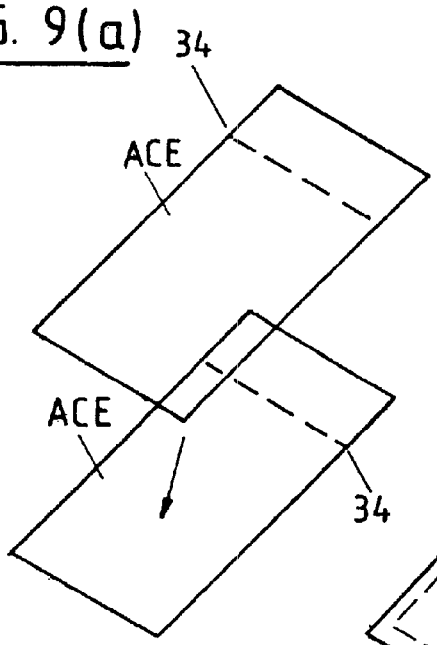
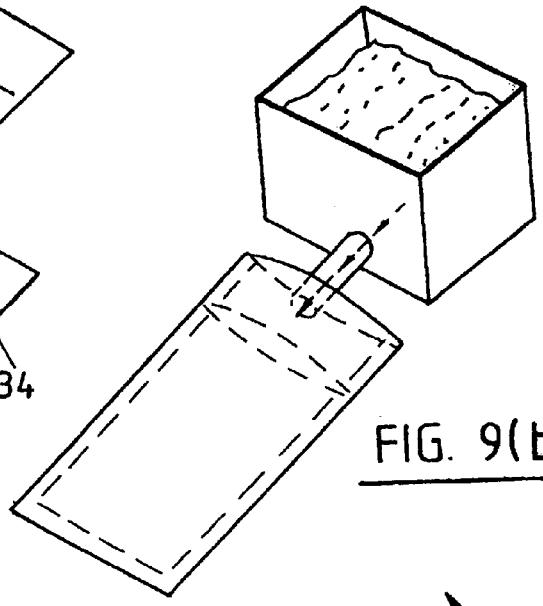
FIG. 9(b)
FIG. 9(c)
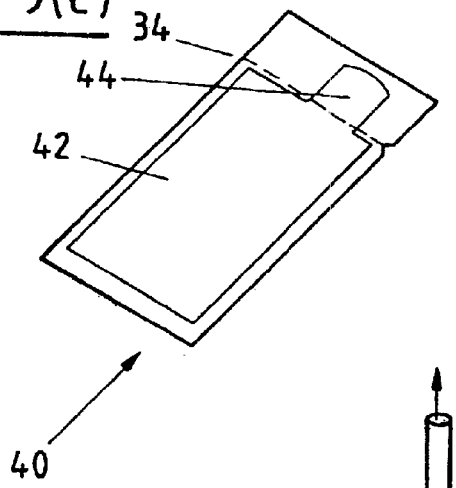
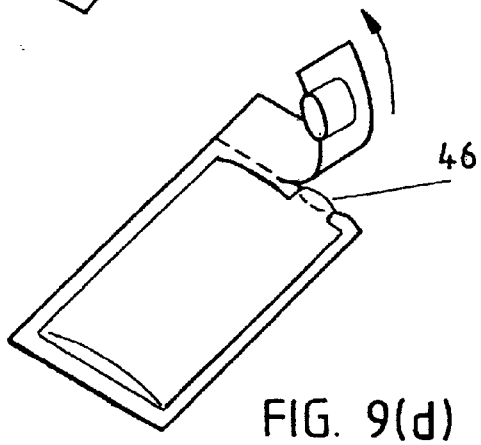
FIG. 9(d)
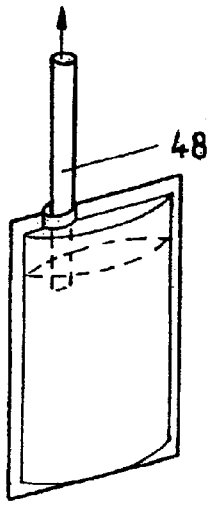
FIG. 9(e)

FIG. 11(a)
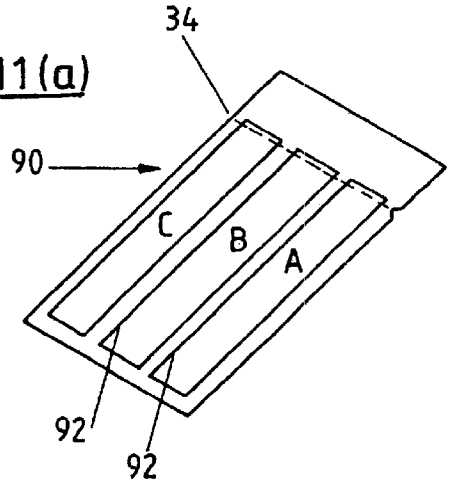
FIG. 11 (b)
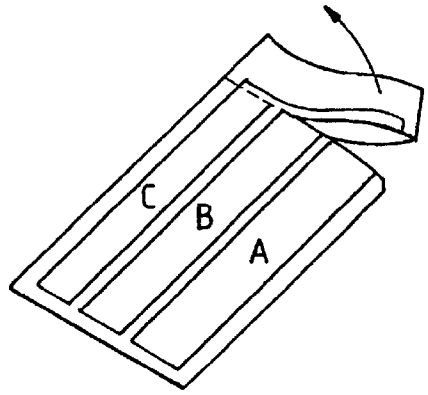
FIG. 11(c)
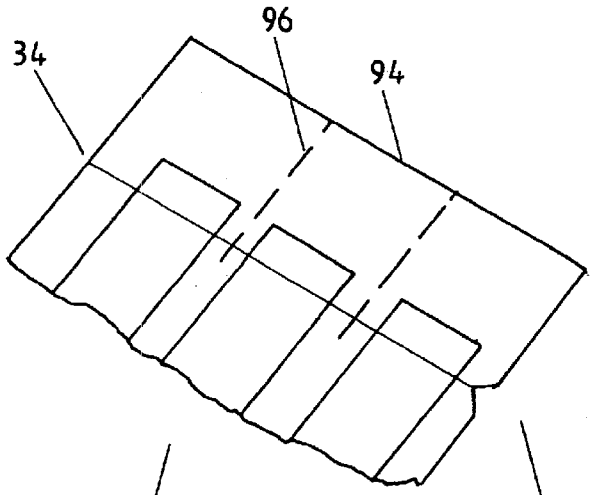
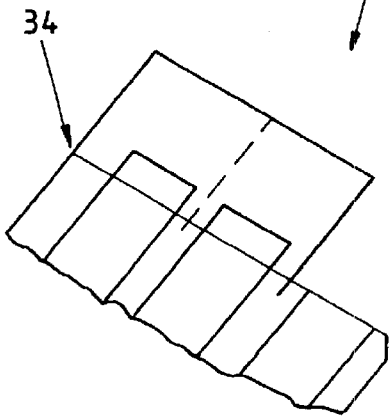
FIG. 11(d)
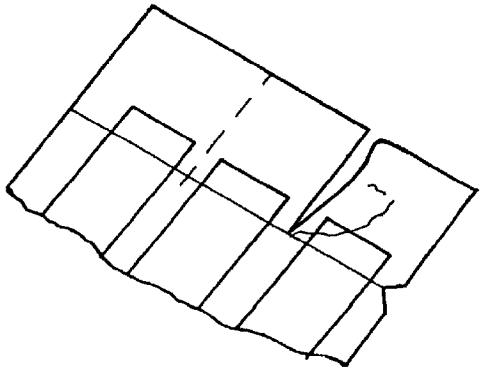
FIG. 11(e)

EASY TEARING BAGS AND PACKAGING MATERIAL

BACKGROUND OF THE INVENTION

1. Field of Invention

This invention relates to bags, packages or packaging material which can easily be torn, without the need for scissors, for instance. In particular, although not exclusively, the invention relates to sealable plastic bags for the containment of food or beverages. However the invention is not limited in its application to food packages and may have application to other industries such as pharmaceuticals 2. Background to the Invention The waterproof, air-tight and durable nature of plastic bags means that they are widely used for packaging goods. Various ways for facilitating the opening of such bags are known. The simplest approach is to print a line on the bag to indicate where an opening should be cut. This cut might open directly onto the contents of the package (eg FIG. 1) or it might open onto a spout integrated into the package (eg FIG. 2; see also U.S. Pat. Nos. 4,491,245, 4,793,121 & 4,935,283 and the "Ampac™ spout-pack"). Such a spout also makes a convenient opening for the insertion of a drinking straw.

Bags are also available which can be opened without the need for scissors. Whilst this can be achieved very easily by simply perforating the intended opening, this is not suitable where the package must be kept air-tight (eg liquids or perishable goods). To overcome this difficulty, it is known to integrate a guide wire or string into a package which, when pulled, opens the package (eg FIG. 3). Another system incorporates two strong parallel tracks into the plastic which define a channel between them (eg FIG. 4). The end of this channel typically contains a nick in the plastic. When tearing begins at his nick, the two tracks guide the tear down the channel, giving a straight tear.

U.S. Pat. No. 5,552,202 describes an arrangement for guiding a tear which utilises bonded strips of materials which differ in stiffness. This difference assists the breaking of the bond between the strips and guides a tear along the bond.

GB patent 1,147,846 describes how a thin strip incorporated in the body of a sheet can provide a guide for tearing. The thin strip may be either weaker or stronger than the body of the sheet. In the former case, the strip provides a weaker path through the film than the surrounding body, along which a tear is guided; where the strip is stronger, the strip can be easily torn out of the body of the sheet, thereby separating the sheet in two.

In GB patent 1,335,036, a tear is guided by incorporating a flexible reinforcement across a sheet of material. This reinforcement itself contains a localised line of weakness and a tear along the line of weakness is trotted to the attached sheet of material.

These tearing systems can also be integrated into re-sealable bags. Once the tear has been made, the bag can still be re-sealed by means of a ziplock for instance (eg FIG. 5). This gives a tamper-proof re-sealable bag.

It is an object of the invention to provide further means for facilitating the tearing of a sheet of packaging material. It is a further object of at least a preferred embodiment of the invention to provide various types of packages which can be opened easily, and also to provide easy-tear materials and packages which can be manufactured at relatively low cost.

SUMMARY OF INVENTION

In accordance with a first aspect of the present invention, there is provided a bag formed of one or more sheets of flexible material wherein at least one of the sheets is multi layered including an inner layer and an outer layer relative to the interior of the bag, the inner layer having at least one line of weakness with the outer layer being substantially intact along the line of weakness and tearable along the line of weakness, wherein the line of weakness extends from a first edge of the bag.

It will be understood that the bag may comprise one or more sheets. Where the invention comprises two sheets, one or both of them may be multilayered with a line of weakness present in the respective inner layers. The following references to "sheet(s)" therefore may apply to either one sheet having the multilayered construction defined above or both sheets having this multilayered construction.

The line of weakness in the inner layer of the sheet(s) of flexible material acts as a natural guide during tearing of the material ("tearing line"), and can take various forms.

For example, the line of weakness may be a perforated line in the inner layer. In such a case, the individual perforations in the inner layer need not be circular in shape. It might, for instance, be a dot-dash perforation, or any interruption in the inner layer which substantially disconnects the two portions on either side of the line of weakness. As an alternative, the line of weakness may be a zone which is thinner and/or weaker than the rest of the inner layer. Furthermore, the line of weakness in the inner layer may be the interface between two pieces of material with their edges in substantial abutment. (eg see WO98/16382).

It will be apparent that, where a perforated or thin line is used to form the line of weakness, the inner layer will typically be formed from a single piece of material. Where essentially abutting pieces are used, however, the inner layer may be formed from pieces of different materials which together form the inner layer.

In preferred embodiments, the line of weakness is substantially straight.

In order to facilitate the initiation of a tear, preferred embodiments include a small opening, break, nick, notch or the like along the first edge of the bag. Suitably, the tearing line extends from the first edge of the bag to a second opposite edge. In this case, the nick may be disposed at or adjacent one end or both ends of the tearing line. Furthermore, the tearing line may be visibly indicated on the bag, for example by printing a dotted line at the relevant position.

Being situated in the inner layer, rather than the outer layer, the tearing line is less likely to break or split due to any internal pressure exerted by contents of the package. In addition, the tearing line is protected from external damage such as rubbing.

The inner layer of the flexible sheet(s) is preferably attached to the outer layer of the flexible sheet adjacent to the tearing line for substantially the length of the line of weakness.

The outer layer of the sheet(s) of flexible material can be formed from anything that can be torn. It can thus be formed from, for instance, plastic, paper, metallic film etc.

The inner and outer layers are preferably of the same size or area. The layers may extend across the whole area of the sheet(s) of flexible material.

The sheet(s) of flexible material may, however, comprise additional layers. For example, the outer layer of the sheet(s)

of flexible material need not be the outermost layer of the package; nor need the inner layer be the innermost layer of the package.

Indeed, it may be desirable to ensure that the tearing line is not exposed to the contents of the package, for instance by adding a further layer to the sheet(s) of flexible material. Furthermore, if the sheet of flexible material is to be thermally bonded to another sheet of material ie laminated, it is preferred that it includes an additional layer which protects the tearing line from being sealed itself. This additional layer could, for instance, be heat-sealable at a temperature substantially below that required to melt the inner layer of material containing the line of weakness.

Sheet(s) of flexible material for use in the manufacture of bags or packages according to the invention can be produced in a number of ways. Where tie line of weakness in the inner layer is a perforated line, the sheet(s) can be formed simply by bonding two layers, one of which contains a perforated line. Alternatively, a thin band of material containing a perforation could be attached to a sheet(s) of flexible material to define the line of weakness.

Similarly, where the line of weakness is a thin zone in the inner layer, the material can be formed by bonding two layers of flexible material, one of which contains a thin zone. The thin zone can be created by infra red or laser, or by mechanical means.

International patent application WO98/16382 describes how in plastic laminates, a plurality of pieces in the form of strips may be placed with their longitudinal edges in substantially abutting relationship. The interface between abutting strips forms a line of weakness. With reference to the two-layer laminated material described in WO98/16382, layer "A" can form the outer layer of the flexible material used in the present invention, and layer "C" (formed from abutting strips) can form the inner layer.

The strips which make up layer "C" may be made from the same or different materials, as set out in WO98/16382 (eg alternating transparent and opaque strips, such as holographic or metallised strips). It will be appreciated tat, where two abutting strips are of the same material, they can be formed by cutting a sheet of material into two before laminating to the outer layer, where the abutting strips are of different materials, however, they will typically be supplied from separate supply rollers.

Furthermore, layer "E" in the three-layer laminate of WO98/16382 can form a layer additional to the inner and outer layers of the present invention, to protect the tearing line from the contents of the package or during thermal bonding. FIG. 6 shows an example of a suitable sheet of material comprising three layers. It will be appreciated that, unlike the tear-guiding materials disclosed in the prior art, the present invention does not require any additional or special material to be incorporated into the bag or package in order to guide the tear, as the line of weakness is integral to the sheet(s) of flexible material. Thus, there is minimal additional production cost For example, a line of weakness can be formed simply by cutting the inner layer into two pieces, or by introducing a perforation or thin zone, before bonding to the outer layer—no extra material is required. Furthermore, the present invention does not rely on any difference in mechanical strength of the materials either side of the line of weakness. Nor does the line of weakness "enable" tearing of the package—the outer layer is made of tearable material, and the line of weakness serves to control or guide the tear along a predetermined route.

In addition, the inner and outer layers of material which are used in the bags or packages of the invention may be made from any suitable flexible materials (eg plastics, paper), provided that the outer layer is tearable and the inner layer includes a line of weakness.

The bags or packages of the invention can take various forms, all of which utilise "one or more sheets of tearable flexible material, with one or more of the sheets including an outer layer and an inner layer, the inner layer being provided with a line of weakness", hereafter simply an "easy-tear sheet".

These packages will typically be over-printed with a design or pattern.

An easy-tear sheet may, for instance, be attached to a sheet of non-tearable material and sealed to form a package which can be opened along the tearing line of the easy-tear sheet. For example, the invention provides a bag having a easy-tear front sheet and a non-tearing back sheet, sealed together at or adjacent the edges of the two sheets.

Where the line of weakness is the interface between abutting pieces, the invention thus provides a bag with a front and a back, with two abutting pieces of material situated between the front and the back, the line of abutment constituting a tearing line.

Alternatively, an easy-tear sheet may be attached to another easy-tear sheet eg a bag can be formed having a front and a back each of which are easy-tear sheets. These two sheets can be positioned such that the tearing lines in the two sheets are aligned (ie essentially co-linear, but possibly deviating slightly eg within 1 mm), thus ensuring that the tear in the front and back sheets of the bag are also aligned. In the empty state of the bag the two sheets may lay directly one upon the other with the sheets sealed at or adjacent their edges.

Bags of the invention can also be produced by folding a single easy-tear sheet back on itself so that the tearing line is aligned with itself.

In addition, bags according to the invention may incorporate means for re-sealing an opened bag, such as a zip-lock In such embodiments, the tearing line should be straight.

Packages or bags of the invention are preferably sealed around the periphery of the sheets. Additionally, the sheet(s) may be sealed together adjacent the tearing line for substantially the length of the tearing line. A gusset portion may be accommodated into the bag with the sealing of the sheet(s) accommodating the gusset portion.

In one preferred form of the invention, the interior of the bag includes a main portion and a spout portion narrower than the main portion and extending beyond the main portion with the tearing line extending across the spout portion such that the spout portion is openable on tearing along the tearing line. Preferably, the spout portion is sealed closed on filling of the bag. After opening, the contents of the package may be sucked or squeezed out. The spout may also be of a size and shape which allows it to be plugged or stopped As well as being suitable for pouring, the spout-like opening can also accept articles such as drinking straws, pipes, pumps etc. These may be included wit the sealed package where appropriate eg the sealed bag or package may include an integral drinking straw such that, when the package is torn open, the drinking straw is already immersed and ready for use. The immersed drinking straw can preferably be extended after the package is torn open.

In packages containing an immersed drinking straw, the line of weakness will typically be substantially straight, and will guide the tear away from the portion of the package containing the beverage, in order to avoid spillage.

Placing a drinking straw inside a bag or package together with a beverage offers a number of advantages eg production costs are lower, because the straw is not packaged separately; the straw will not be lost inadvertently; the straw is more hygienic, as it cannot be contaminated after it is packaged.

Packaging a drinking straw in situ with a carbonated beverage in particular offers advantages over conventional carbonated beverage packages (ie plastic bottles and cans). Although still beverages, such as orange juice, are often distributed in packages which are punctured by drinking straws in order to access the beverage, this form of packaging is not suitable for carbonated beverages—due to the sudden pressure change when the package is punctured, the carbonated drink is forced out of the package through the straw, causing spillage. In the packages of the present invention, however, when the package is tom open along the tearing line, the in situ drinking straw provides a buffer zone allowing the internal and external pressures to equilibrate, thereby preventing spillage. As no puncturing operation is required, the problem of spillage caused by sudden pressure change is avoided or minimised Furthermore, flexible packages for carbonated beverages offer advantages over traditional hard containers such as production cost, storage space and cost when empty, transportation space and cost when empty, and environmental concerns.

Similarly, packaging a straw or tube or other opening within a sealed bag or package, such that the contents can leave the package via the straw or tube, offers hygienic advantages in other situations eg medical situations, where the contents of the bag and straw/tube can both be packaged in sterile conditions. When the bag is tom open, the contents can be accessed easily, without the need to introduce a potentially-contaminated straw/tube from an external source.

The sheets of flexible material used to produce bags or packages of the invention may comprise more than one line of weakness. Where a single sheet comprises two parallel lines of weakness, for instance, the sheet is, in effect, divided into three strips, the middle of which may easily be removed or separated from the bag. The easy-tear sheet may thus be in the form of a cover for a bag or package, a strip of which can be torn away to give access to the contents of the bag or package. Each pair of tearing lines allows a separate strip of the sheet to be removed, each of which can give access to a different region of the package.

The package may contain a plurality of separate internal compartments. Partitions may be provided between adjacent compartments. The partitions may be created by sealing the two sheets together at the locations corresponding to the partitions. If a tearing line crosses the partition between two separate compartments, both compartments can be opened with one tear. If it is desired to halt the tear between opening successive compartments, this can be achieved by, for instance, providing a slight break in the tearing line.

Furthermore, means for assisting the removal of portions of the bag which have been opened may be incorporated. For instance, if perforations are included which are within the partition between two compartments and which cross the tearing line, the tear will tend to halt when it meets the perforation, and the torn part of the package can be removed by tearing along the perforated line, rather than along the tearing line. Alternatively, in certain embodiments, the perforated line could be torn first, stopping when the tearing line has been crossed, followed by tearing along the line of weakness. In this case, the junction between the perforation and the tearing line acts as a nick for facilitating initiation of the tear. Where a tear starts from the edge of the package, the tear can still be initiated, although a little more force may be required.

Packages of the invention are also suitable for storing liquids, such as beverages. In a preferred embodiment, the package of the invention comprises a first and a second sealed internal compartment. The first sealed internal compartment contains a drinking straw which can be accessed by removing a portion of the package along the package's tearing line. The second sealed internal compartment contains a beverage. The beverage is not accessed via the tearing line used to access the drinking straw, however, but by puncturing the package using the drinking straw. Thus the package contains a beverage and a drinking straw, with the straw stored in sanitary conditions within the package, preventing its inadvertent loss, but separate from the beverage. In addition, the tear is guided without tearing the package such that the beverage spills, This approach to packaging a drinking straw is a less-preferred alternative to the "immersed straw" approach described above.

In accordance with a second aspect of the present invention, there is provided a bag formed of one or more sheets of flexible material wherein at least one of the sheets is multi layered including an inner layer and an outer layer relative to the interior of the bag, the inner layer including two pieces with substantially abutting edges and having at least one line of weakness which is defined by the interface of the two pieces with the outer layer being substantially intact along the line of weakness and tearable along the line of weakness.

The interface between the abutting pieces creates in effect a thin straight channel ("tearing line") in the bag, along which a tear is naturally guided This allows the bag to be opened easily.

If desired, there may be more than one layer of abutting pieces between the front and the back of the bag. For instance, a bag could be formed from two sheets of laminated plastic material, both of which comprise a layer consisting of abutting pieces of material. These two sheets can be juxtaposed such that the layers comprising abutting pieces are both between the front and back of the bag, with their lines of abutment aligned (ie essentially co-linear, but possibly deviating slightly eg within 1 mm). This creates, in effect, a composite tearing line.

A suitable laminated plastic material which contains a tearing line is one which may be made using the method as disclosed in International Patent Application WO98/16382 as discussed previously. Briefly, the laminated plastic comprises a base layer onto which are adhered a plurality of parallel strips of material which abut and do not overlap. An example of a suitable laminated plastic material, which also comprises a third layer, such that the abutting parallel strips are sandwiched, is shown in FIG. 6, and this type of material is used in the most preferred embodiments of the invention.

In preferred embodiments, one end or both ends of the tearing line contains a small opening, break, nick, notch or the like. This facilitates the initiation of a tear. The tearing line may be visibly indicated on the bag, for example by printing a perforated line at the relevant position.

The bag is preferably sealed at or adjacent its edges. In one preferred form of the invention, the interior of the bag includes a main portion and a spout portion narrower than the main portion and extending beyond the main portion with the tearing line extending across the spout portion such that the spout portion is openable on tearing along the tearing line. Preferably, the spout portion is sealed closed on filling of the bag. After opening, the contents of the package may be sucked or squeezed out. The spout may also be of a size and shape which allows it to be plugged or stopped.

It will be appreciated that the sheet(s) of flexible material which are used to make the bag may comprise more than two layers. For instance, whilst they might comprise just a base layer and a layer of abutting parallel strips, they might also comprise a further layer, covering and protecting the abutting parallel strips, for instance. Suitably, the layers of each of the sheets will be laminated together. Furthermore, the sheets will typically be over-printed with a design or pattern. The front and back of the bag need not, of course, be made from the same material.

The parallel abutting pieces within the laminated plastic may be made from the same or different material. For instance, both pieces could be transparent, or one strip could be metallised whilst the other is transparent.

In addition, bags according to the invention may incorporate means for re-sealing an opened bag, such as a zip-lock.

In accordance with a third aspect of the present invention, there is provided an enclosure or package formed of two overlapping sheets of flexible material wherein, in an empty state of the enclosure or package, the two sheets lay one directly upon the other, and wherein at least one of the sheets is multi layered including an inner layer and an outer layer relative to the interior of the enclosure or package, the inner layer having at least one line of weakness with the outer layer being substantially intact along the line of weakness and tearable along the line of weakness.

Preferably first and second lines of weakness are formed on respective ones of the sheets, the lines of weakness being aligned.

In accordance with a fourth aspect of the present invention there is provided an enclosure or package formed of one sheet of flexible material folded back on itself to define two sheet portions wherein, in an empty state of the enclosure or package, the two sheet portions lay one directly upon the other and wherein the sheet is multi layered including an inner layer and an outer layer relative to the interior of the enclosure or package, the inner layer having at least one line of weakness with the outer layer being substantially intact along the line of weakness and tearable along the line of weakness.

Preferably first and second lines of weakness are formed on respective sheet portions, the lines of weakness being aligned.

In accordance with a fifth aspect of the present invention there is provided a bag formed of two overlapping sheets of flexible material wherein at least one of the sheets is multi layered including an inner layer and an outer layer relative to the interior of the bag, the inner layer having a first line of weakness with the outer layer being substantially intact along the first line of weakness wherein the other sheet also includes a second line of weakness substantially aligned with the first line of weakness such that the bag is tearable along the two lines of weakness.

In accordance with a sixth aspect of the present invention there is provided a bag formed of one sheet of flexible material folded back on itself to define two sheet portions wherein at least one of the sheet portions is multi layered including an inner layer and an outer layer relative to the interior of the bag, the inner layer having a first line of weakness with the outer layer being substantially intact along the first line of weakness wherein the other sheet portion also includes a second line of weakness substantially aligned with the first line of weakness such that the bag is tearable along the two lines of weakness.

In accordance with a seventh aspect of the present invention, there is provided a bag formed with a front and back and a straight line of weakness formed between the front and the back such that the bag is tearable along the line of weakness, the bag further having a strip of flexible material inserted between the front and the back, the strip extending substantially parallel to the line of weakness such that the strip is adapted to function as a handle when the bag is torn along the line of weakness.

Preferably the bag is formed of one sheet of flexible material folded back on itself to define two sheet portions wherein at least one of the sheet portions is multi layered including an inner layer and an outer layer relative to the interior of the bag, the inner layer incorporating the line of weakness with the outer layer being substantially intact along the line of weakness.

Alternatively, the bag may be formed of two overlapping sheets of flexible material wherein at least one of the sheets is multi layered including an inner layer and an outer layer relative to the interior of the bag, with the inner layer incorporating the line of weakness with the outer layer being substantially intact along the line of weakness.

Preferably, the bag includes a gusset portion formed at an end of the bag opposite to the strip when the bag has been torn along the line of weakness.

In accordance with an eighth broad aspect of the present inventions, there is provided a multi layer packaging material having a first layer and a second layer wherein the first layer includes two pieces with substantially abutting edges and having at least one line of weakness which is defined by the interface of the two pieces with the second layer being substantially intact along the line of weakness and tearable along the line of weakness.

BRIEF SUMMARY OF THE DRAWINGS

The invention will now be described by way of example with reference to the accompanying drawings in which:

FIGS. 11*a* and *b* illustrate a bag or package constructed in accordance with a seventh preferred embodiment of the present invention;

FIGS. 11*c* to *e* illustrate a bag or package constructed in accordance with an eighth preferred embodiment of the present invention;

BEST MODES FOR CARRYING OUT THE INVENTION

Figures 1A, 1B, 1C:
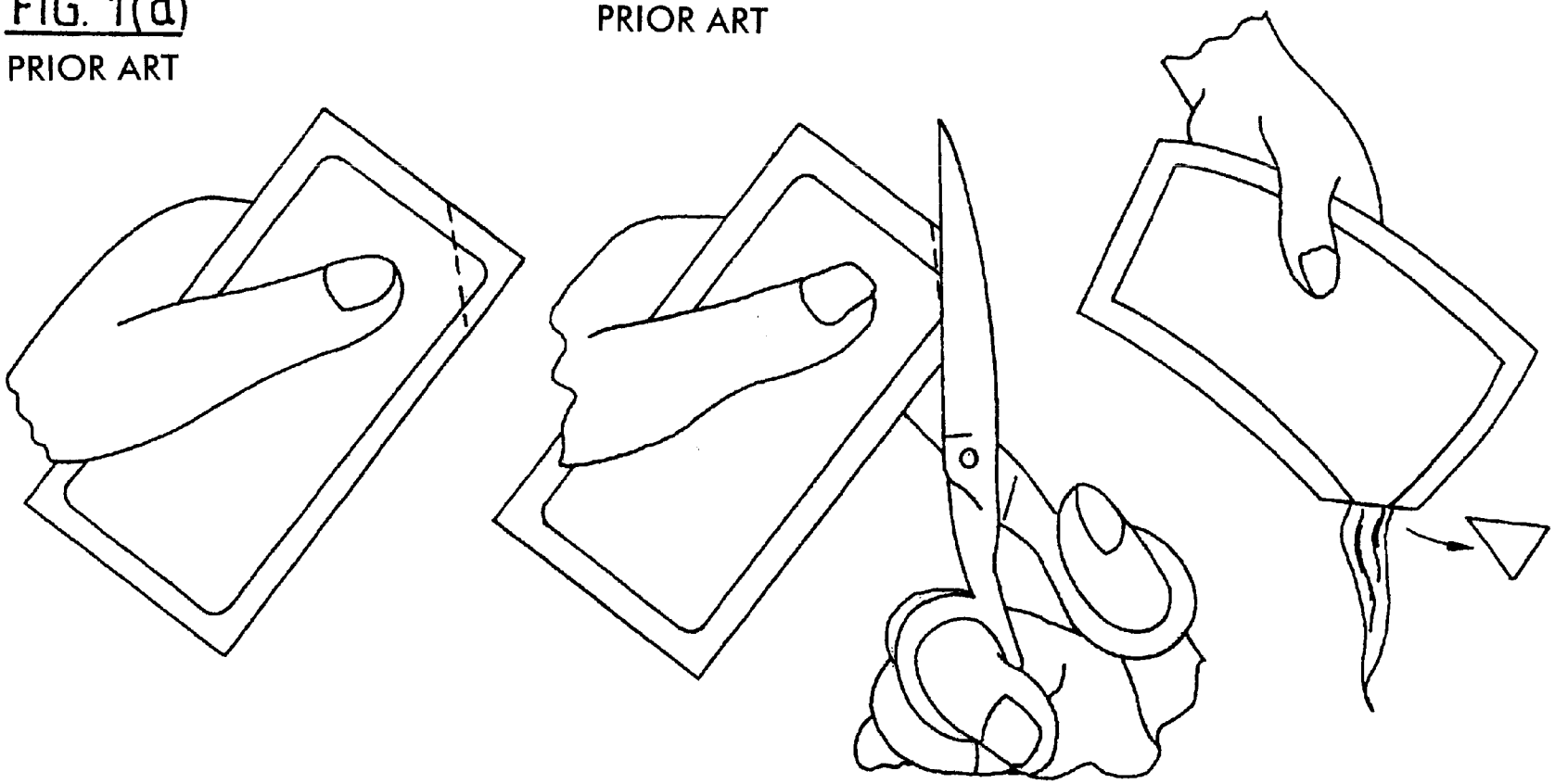
FIG. 1(a) PRIOR ART
FIG. 1(b) PRIOR ART
FIG. 1(c) PRIOR ART
FIG. 1 illustrates a conventional sealed package.
Figure 2C:
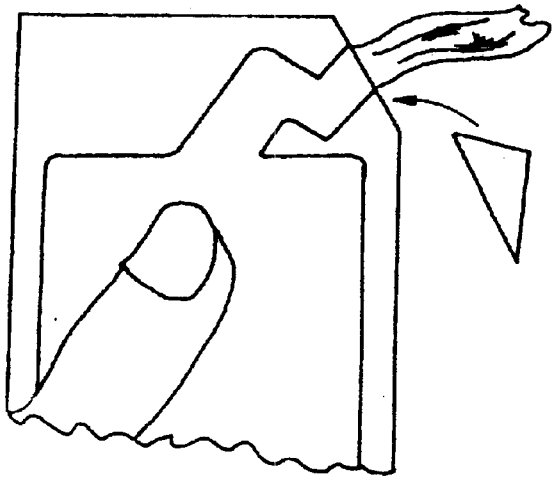
FIG. 2 illustrates another prior art sealed package.
Figure 2B:
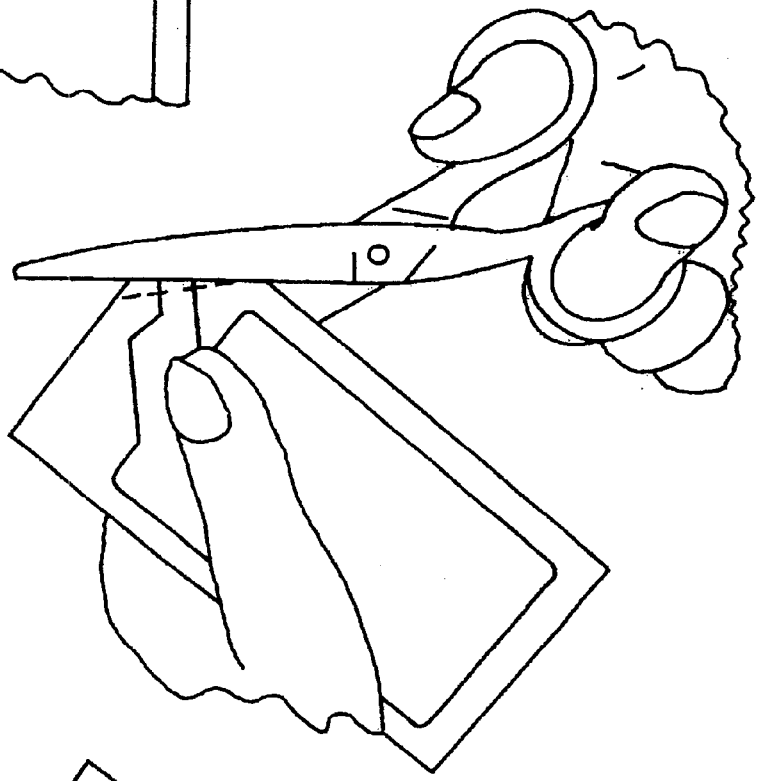
Figure 2A:
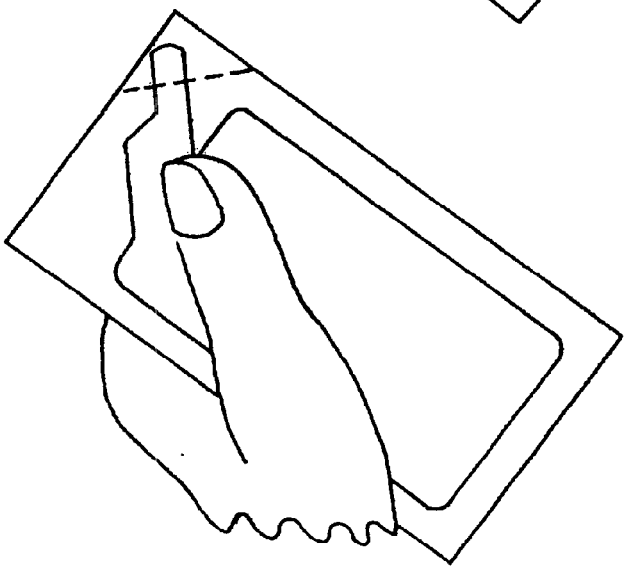
Figure 3A:
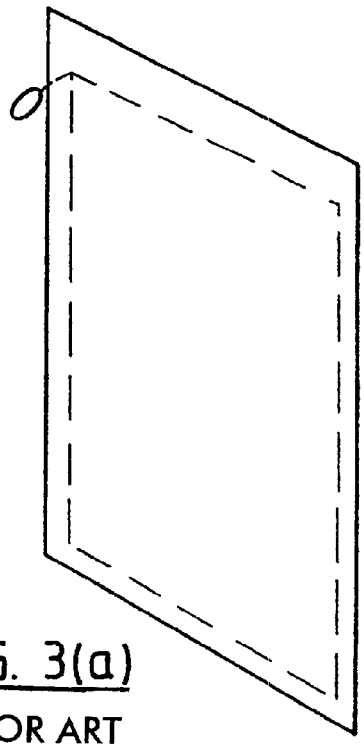
FIG. 3(a) PRIOR ART
FIG. 3 illustrates yet another prior art form of sealed package.
Figure 3B:
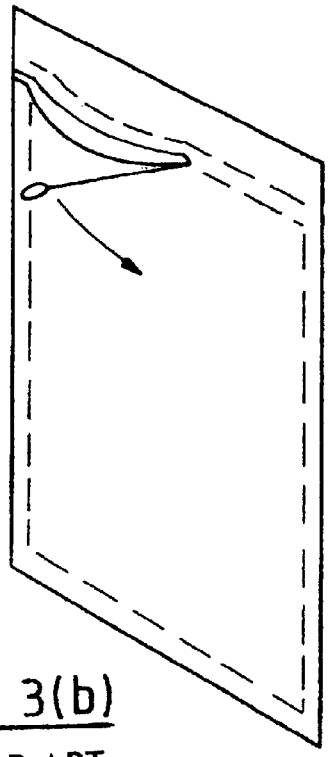
FIG. 3(b) PRIOR ART
Figure 4A:
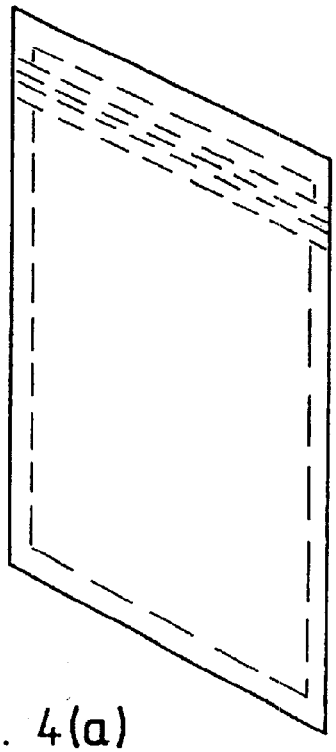
FIG. 4(a) PRIOR ART
FIG. 4 illustrates a further prior art sealed package.
Figure 4B:
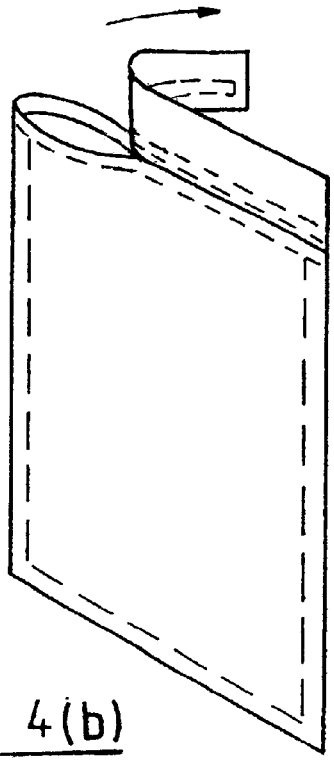
FIG. 4(b) PRIOR ART
Figure 5D:
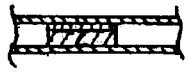
FIG. 5(d) PRIOR ART
FIG. 5 illustrates still another prior art package.
Figure 5C:
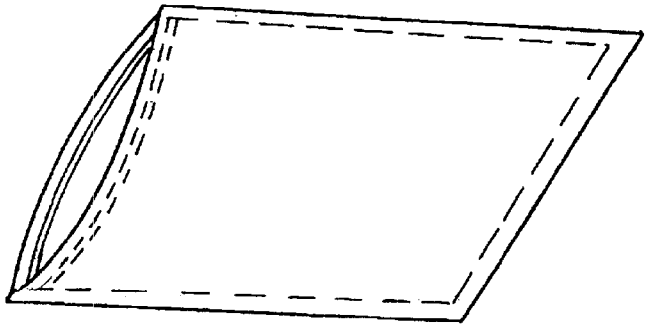
FIG. 5(c) PRIOR ART
Figure 5B:
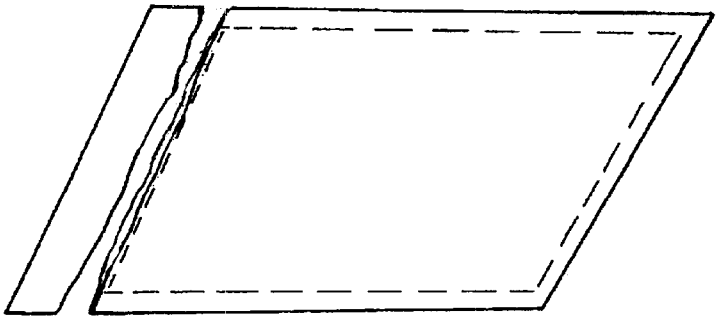
FIG. 5(b) PRIOR ART
Figure 5A:
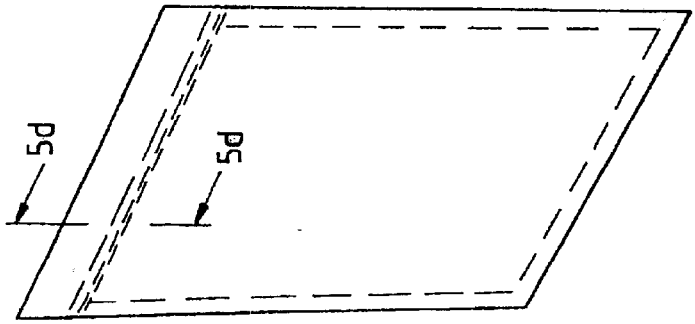
FIG. 5(a) PRIOR ART
Figure 6A:
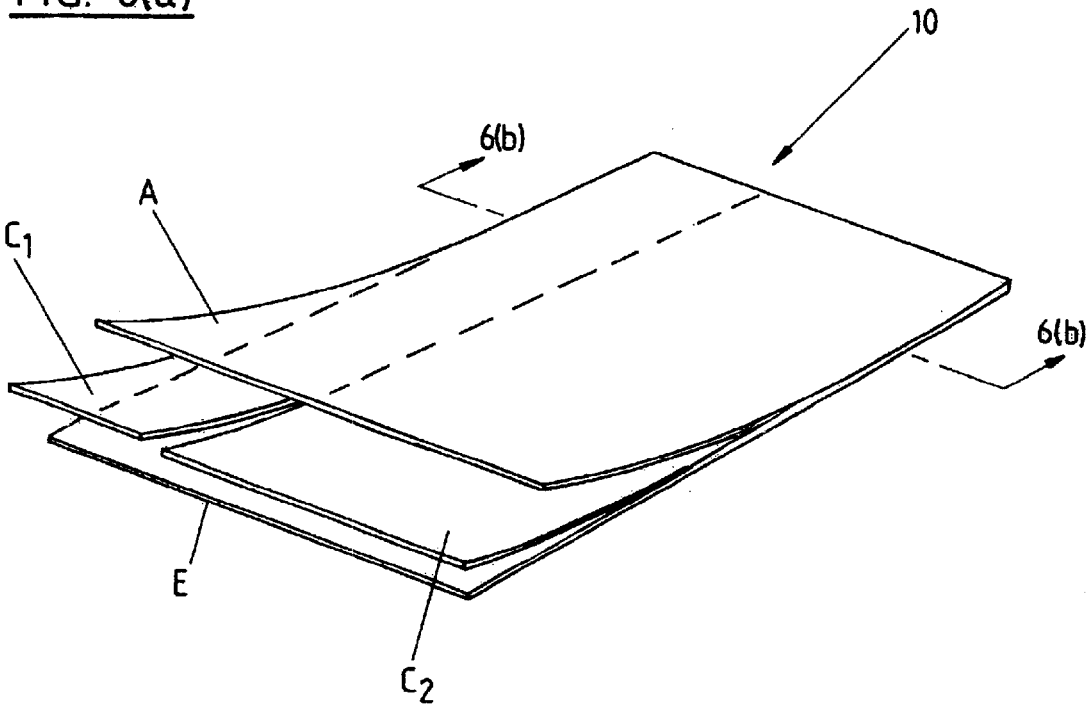
FIGS. 6*a* and 6*b* illustrate the composition of a sheet of laminated plastic material which can be used to make the bag or packages according to the present invention.
Figure 6B:
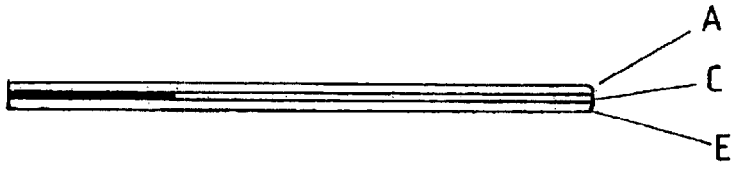
Figure 6C:
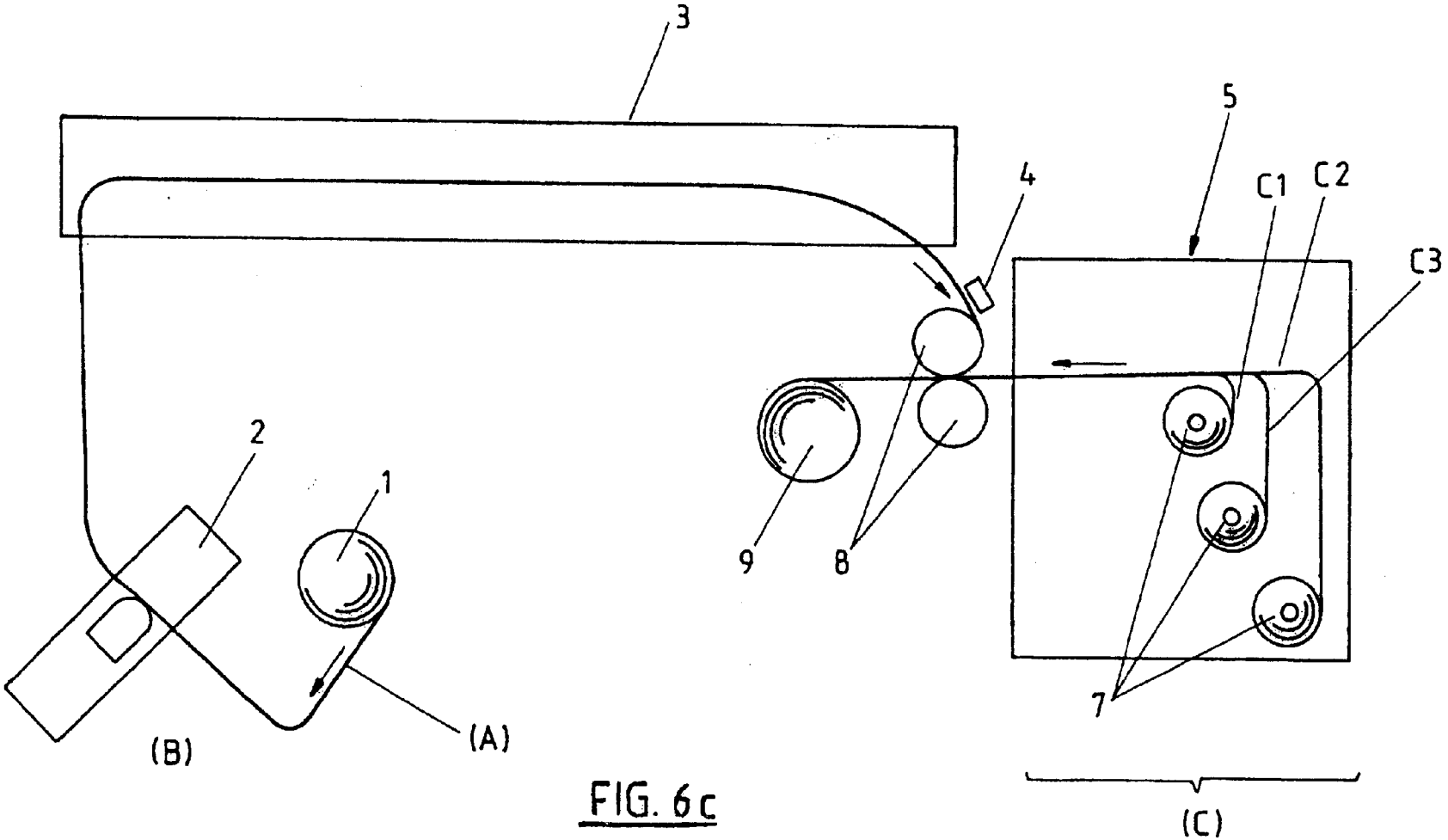
FIG. 6*c* illustrates an apparatus for manufacturing the sheet of laminated plastic material shown in FIGS. 6*a* and 6*b;*

FIGS. 6(*a*)–6(*b*) illustrate a sheet 10 of flexible plastic material which may be used to make any of the bags illustrated in FIGS. 7 to 16. The sheet 10 comprises an outer layer A and inner layer C and an additional layer E. Layer A might for example, be a transparent film made from polyethylene, over-printed with a design. Layer C is formed of two adjacent parallel strips $C_1$, $C_2$ which are substantially in abutment along their adjacent longitudinal edges. The two strips $C_1$ and $C_2$ do not overlap. The strips might, for instance, be a wide transparent strip $C_2$ abutting with a thin metallised holographic strip $C_1$. Layer E is typically a heat-sealable film. The three layers A, C, E are laminated together by the apparatus illustrated in FIG. 6*c* which is a drawing from International Patent Specification No. WO98/16382. The contents of this International specification are hereby incorporated herein by reference.

In the apparatus illustrated in FIG. 6*c*, the transparent film A is loaded onto supply roller 1. Similarly the strips $C_1$, $C_2$, $C_3$ which form layer C are loaded onto respective supply rollers 7 which are mounted on system 5. The rollers 7 are laterally arranged such that the edges of the strips leaving the rollers 7 which make up layer C are in substantial abutment.

During operation, film A proceeds through the glue tank to where adhesive layer B is applied to its back surface and then into drying tunnel 3. At the heated roller assembly 8, layer A meets the strips which form layer C. The strips are bonded to adhesive layer B to form a laminated material AC which is collected on receiving roller 9.

To complete the packaging material, the laminate AC is removed from the receiving roller 9 and reloaded onto supply roller 1. The process is repeated on material AC, with adhesive being applied to layer C and the heat sealable film E (not shown in FIG. 6*c*) being attached to form finished product ACE laminate.

It will be appreciated that the finished ACE laminate may be cut into smaller sheets suitable for the production of the bags illustrated in FIGS. 7 to 14. As such, the strips $C_1$, $C_2$ . . . are commonly referred to as "pieces" in the specification although they originate from the longitudinal strips.

Figures 7A, 7B, 7C, 7D:
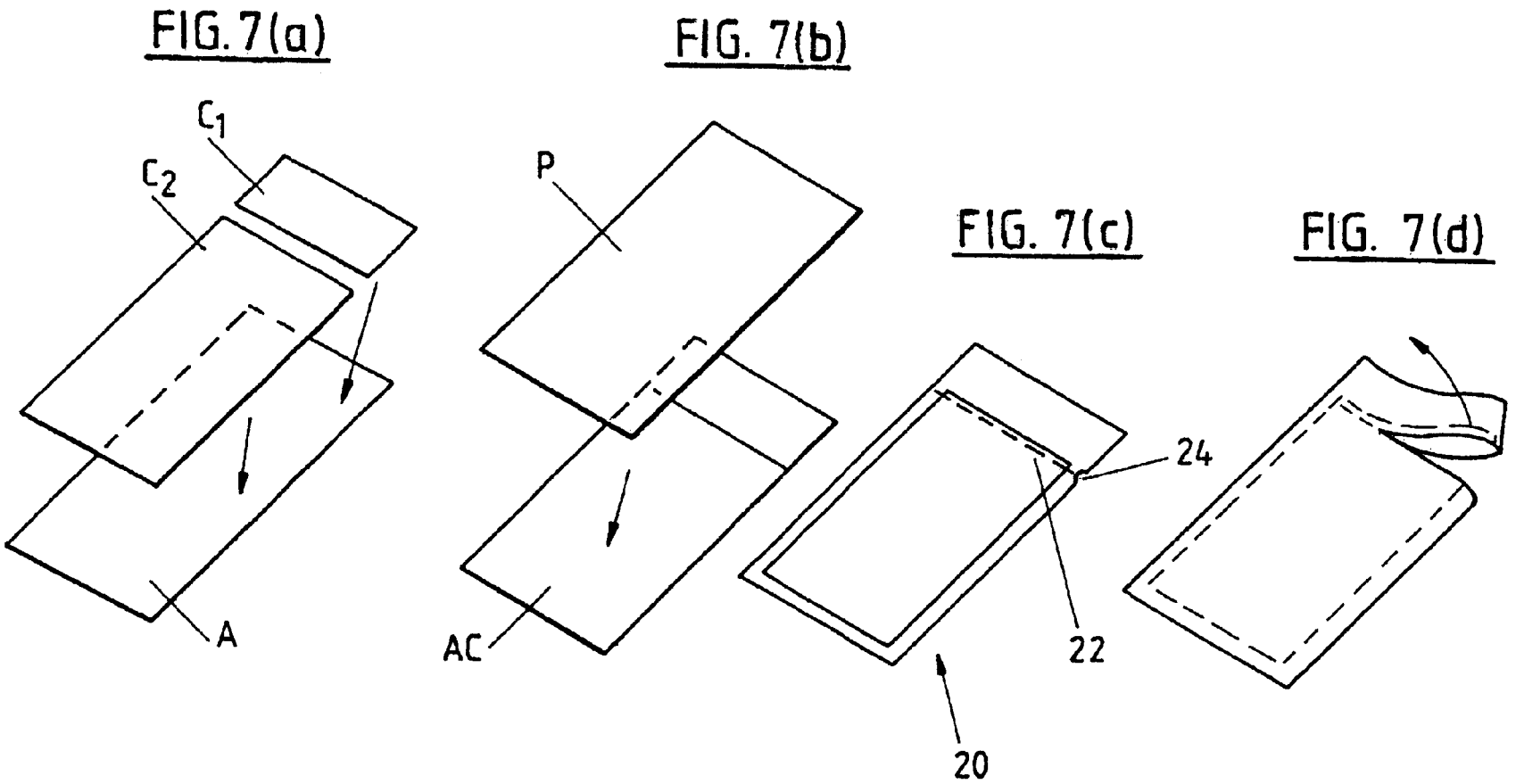
FIGS. 7(*a*)–7(*d*) illustrate a bag or package constructed in accordance with a first preferred embodiment of the present invention.

FIG. 7 illustrates a first preferred bag. As shown in FIG. 7*a*, a sheet of laminated plastic material AC is formed from an outer layer A of transparent plastic material and an inner layer consisting of two abutting pieces, the first $C_1$ being a thin metallised strip and the other $C_2$ being a transparent piece. The laminated sheet AC may be formed using the first part of the method described in conjunction with the apparatus shown in FIG. 6*c*.

The laminated sheet AC is aligned with a sheet of strong polythene P and these two sheets are sealed around all four edges as illustrated in FIG. 7*c* to form a bag 20. In the assembled bag, the line of abutment between sheets $C_1$, and $C_2$ defines a line of weakness to guide a tear along the sheet of laminated material AC. This is illustrated by dotted line 22 shown in FIG. 7*c*. It can also be seen from FIG. 7*c* that the top end of the bag 20 is sealed together for substantially the area of the strip $C_1$, almost down to the line of weakness 22 in the laminated sheet AC. Since the bag will be filled and sealed in use, the unsealed areas of the first sheet AC and the second sheet P will be separated. With the two sheets sealed adjacent the line of weakness 22 for the complete length of the line of weakness, this will provide a guide for straight tearing along the line of weakness.

Additionally, it can be seen that a nick 24 is made along a first edge of the bag 20, the nick 24 being located at the line of weakness 22 to provide easy initiation of the tear along the line of weakness 22. Suitably, the nick 24 is made in both sheets. In a less preferred embodiment the nick can be made in only the transparent outer layer A, prior to the laminated sheet being formed. This bag is less preferred because it does not enable tearing of the polythene sheet P.

The second embodiment illustrated in FIGS. 8(*a*)–8(*d*) utilises two sheets of the ACE laminate illustrated in FIG. 6. Each of the sheets ACE include three layers namely:

- a transparent outer layer A over-printed with a colour pattern;
- an inner layer C comprising two abutting pieces, one being a thin metallised strip and the other being a wide transparent piece;
- and an additional transparent layer.

Figure 8A:
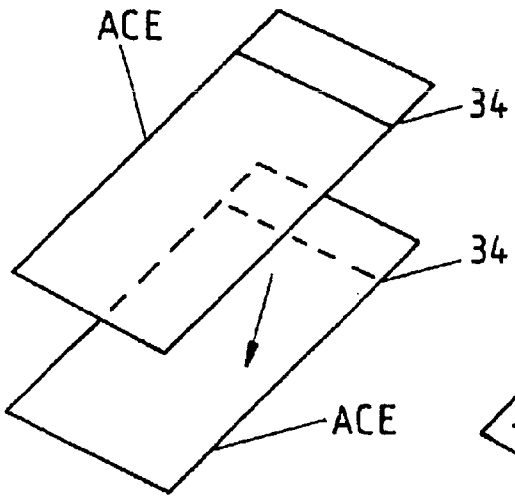
FIGS. 8(*a*)–8(*d*) illustrate a package or bag constructed in accordance with a second preferred embodiment of the present invention.
Figure 8B:
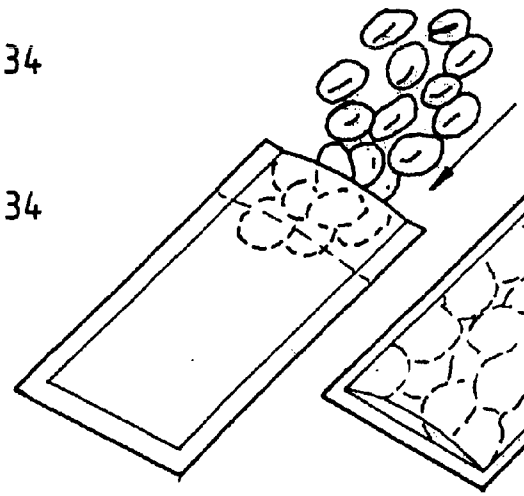
Figure 8C:
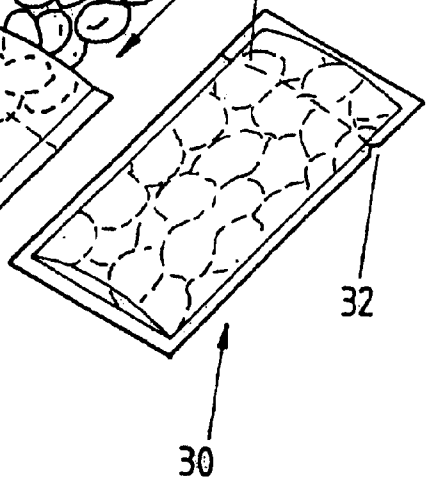
Figure 8D:
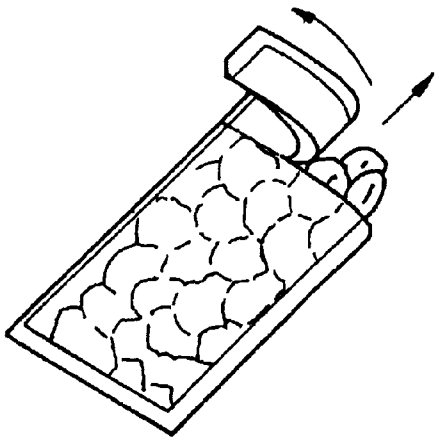

The two sheets ACE of laminated flexible material are aligned and overlapped with one sheet laid directly upon the other, ensuring that the interface between the abutting pieces on respective sheets are aligned. As illustrated in FIG. 8*b*, three edges of the two sheets are heat sealed together leaving unsealed aligned edges at one open end The bag can then be filled with contents as illustrated in FIG. 8*b* through the open end prior to the edges at the open end being sealed as illustrated in FIG. 8*c*. The bag 30 so formed is then provided with a nick 32 along a first edge of the bag 30, the nick being at or adjacent the lines of weakness 34 provided on the two sheets ACE. The nick 32 facilitates initiation of the tear along the lines of weakness to release the contents of the bag in the manner illustrated in FIG. 8*d*.

Figure 9F:
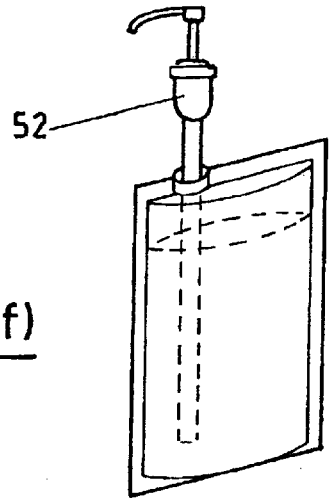
FIGS. 9*a* to 9*g* illustrate a bag or package constructed in accordance with a third preferred embodiment of the present invention.
Figure 9:
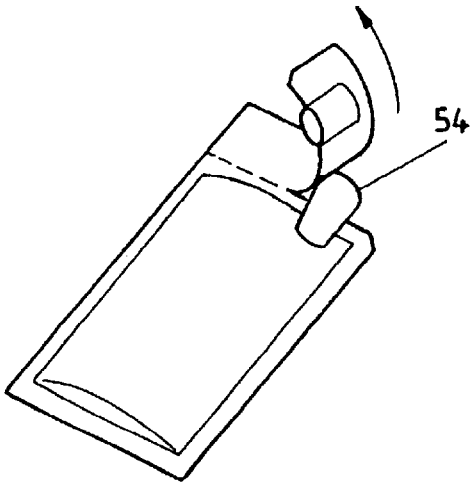
FIGS. 9*h* and 9*i* illustrate a bag or package constructed in accordance with a fourth preferred embodiment of the present invention.
FIG. 9*j* illustrates a bag or package constructed in accordance with a fifth preferred embodiment of the present invention.

FIGS. 9(*a*)–9(*d*) illustrate a fish embodiment using two sheets of ACE laminate material having their respective lines of weakness 34 aligned in the assembled bag 40. Like the embodiment illustrated in FIG. 8, the bag 40 has the two sheets sealed together around three sides. At the end of the bag 40 adjacent the aligned lines of weakness 34, the two sheets are sealed together so as to extend beyond the lines of weakness 34 except for a small gap as shown in FIG. 9*c*. As illustrated, this provides the bag 40 with an interior comprising a main portion 42 and a spout portion 44. The spout portion 44 may be formed with a closed end if the end of the bag 40 is sealed after the contents have been inserted. Alternatively, the spout 44 may be left open initially so that the bag may be filled through the open spout with subsequent closing of the spout portion 44.

It can be seen from FIG. 9*d* that when the bag 40 is torn open along the lines of weakness 34, most of the spout portion 44 is separated from the bag leaving a small opening 46. This opening 46 allows the contents of the bag 40 to be poured more easily and also makes a convenient opening for a straw 48 (see FIG. 9*e*) or a pump 52 (see FIG. 9*f*). The opening 44 may also be plugged or stopped by the use of a stopper 54 as shown in FIG. 9*g*.

Figure 9H:
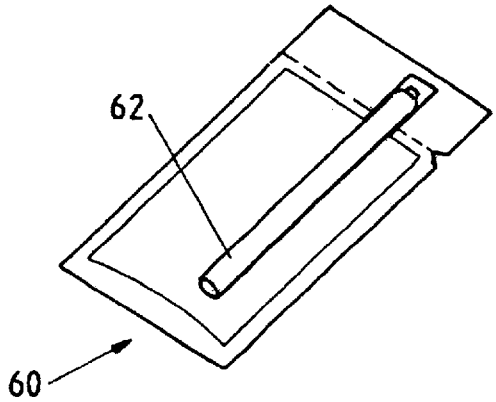
Figure 9I:
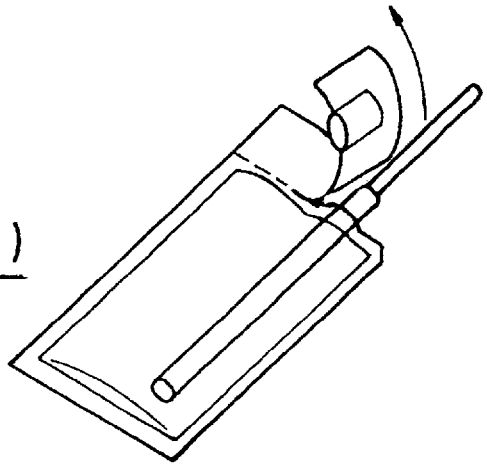

In a fourth preferred embodiment illustrated in FIGS. 9*h* and *i*, a drinking straw 62 may be immersed in the contents of the bag 60. The bag 60 in most respects, is similar to the bag 40 illustrated in FIGS. 9*a* to 9*g*. One end of the drinking straw 62 is received within the spout portion. The drinking straw 62 may be extendable as illustrated in FIG. 9*i*. The provision of a drinking straw scaled within the bag 62 with the drinking straw immersed in the contents is convenient since the straw 62 is ready for use as soon as the package or bag 60 is opened. This is especially useful for carbonated beverages.

Figure 9J:
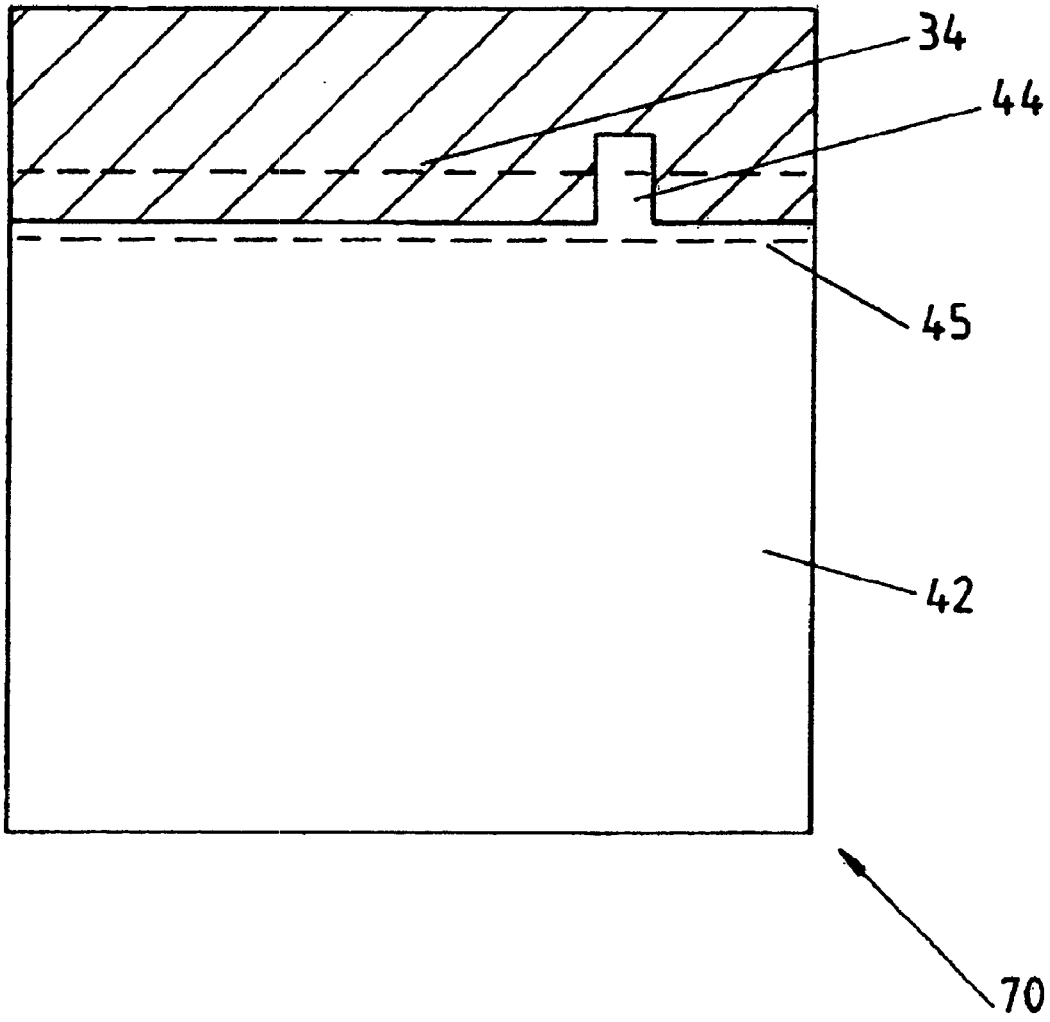

FIG. 9*j* illustrates a fifth preferred embodiment of the present invention. The bag 70 illustrated is similar in construction to the bag 40 illustrated in FIGS. 9*a* to 9*g*. The bag 70 is intended as a food storage bag suitable for microwave cooking of the contents of the bag. Initially, the bag 70 is formed by sealing around three of the edges. Food may be then inserted into the partially open bag whereupon it is vacuum sealed with further sealing occurring on the shaded area illustrated. The sheets making up the bag should be strong enough to withstand vacuum sealing as well as exhibiting minimum deterioration under microwave cooking conditions. Suitably, the material making up the sheets should be such that they can be torn when required along the lines of weakness 34 formed on respective sheets.

Prior to microwave cooking the consumer tears the bag open along the lines of weakness 34. It will be appreciated that this creates a small opening allowing partial release of vapour or gas from the inside of the bag during cooking in order to achieve desirable cooking effects. Depending on the type of food contained in the bag, the size of the opening, which is determined by the size of the spout portion 44, can be determined to ensure optimum cooking conditions for the bag's contents. Undesirable results may occur if the opening is too big or too small. Ease of use is assured because the consumer only needs to tear open the bag to achieve optimum cooking effects.

Following microwave cooking, the contents of the bag may be released by cutting the bag in the normal manner. Alternatively, the bag 70 may be opened by constructing the bag so as to have further aligned lines of weakness 45 in respective sheets extending within the main portion 42 of the bag 70. These further aligned lines of weakness 45 may extend substantially parallel to the lines 34, no greater than 15 mm apart.

Figure 10A:
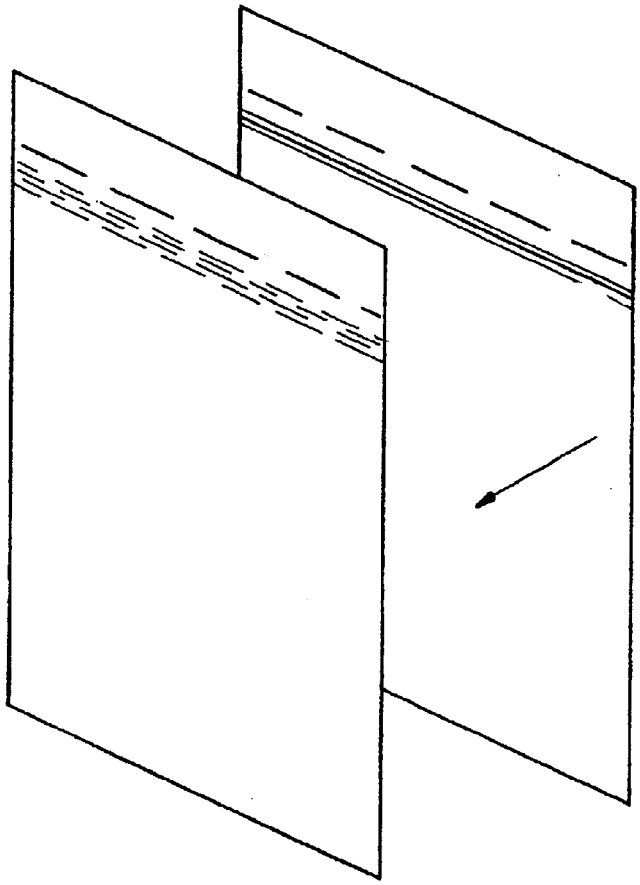
FIGS. 10(*a*)–10(*b*) illustrate a bag or package constructed in accordance with a sixth preferred embodiment of the present invention.
Figure 10B:
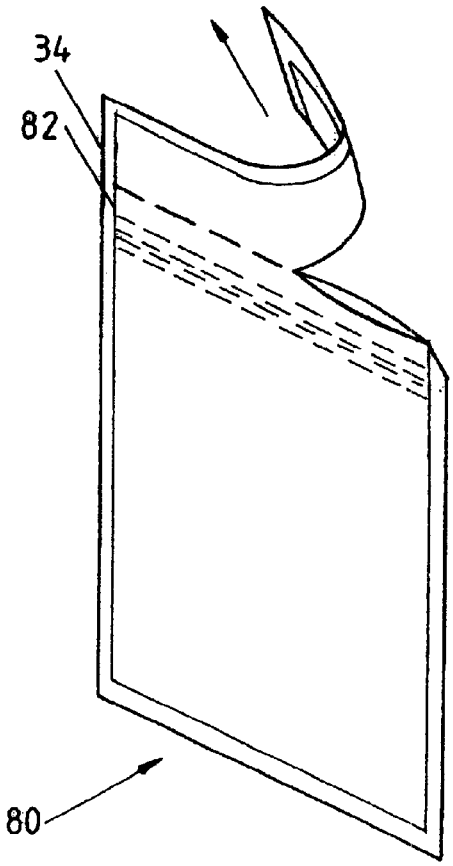

In a sixth embodiment illustrated in FIGS. 10(*a*)–10(*b*), a ziplock is incorporated during manufacture to provide a resealable bag 80. The ziplock 82 is disposed closer to the contents of the bag than the aligned lines of weakness 34. In this way, once the bag has been torn along the lines of weakness 34, the bag can be resealed through the use of the zip-lock 82.

FIGS. 11*a* and 11*b* show a bag 90 which is similar in construction to the bag 30 illustrated in FIG. 8, except that a top end of the bag is sealed to almost the lines of weakness 34 and additionally the bag is sealed together in strips along its length to form partitions 92 thus creating compartments ABC in the bag. It can be seen from FIG. 11*a* that the partitions 92 cross the lines of weakness 34. As this bag is tom open, the compartments A, B and C are opened in series. With a single tearing motion, these three compartments can be opened essentially simultaneously. However, if the tearing motion is punctuated then the compartments can be easily opened one by one. This can be effected by retarding the tearing motion within each of the partitions 92. To achieve this, breaks can be provided in the lines of weakness 34 within the partitions.

By way of example, the sealed end of the bag can be provided with perforations extending from the end edge 94 of the bag towards the lines of weakness 34, extending a short distance across the lines of weakness 34. The perforations 96 will serve to naturally retard the tear at each of the perforated lines 96. Additionally, the edge portions of the bag defined by the tear line and one or more lines of perforation 96 can be torn off along the one or more perforated lines 96 as illustrated in FIG. 11*d*. As an alternative, the perforated line could be torn firs as shown in FIG. 11*e*, followed by a tear along the lines of weakness 34.

Figure 12:
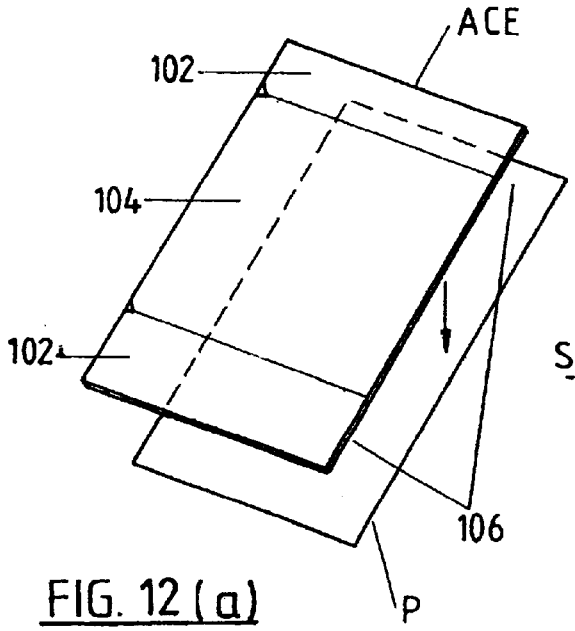
FIGS. 12(*a*)–12(*d*) illustrate a bag or package constructed in accordance with a ninth preferred embodiment of the present invention.
Figure 12:
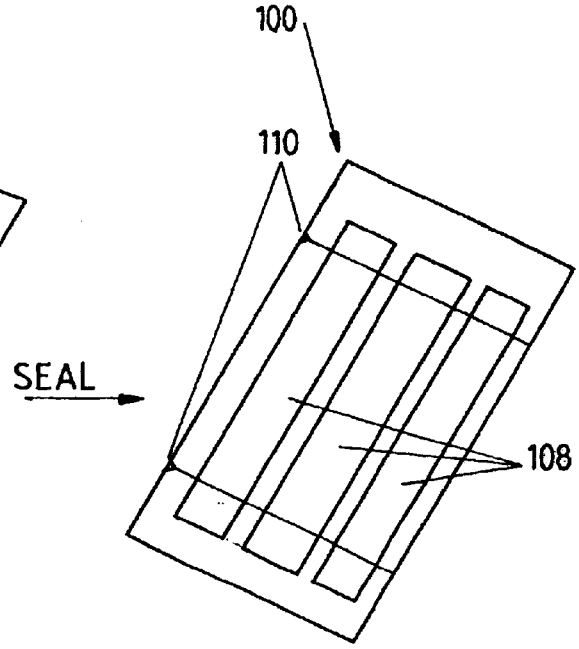
Figure 12:
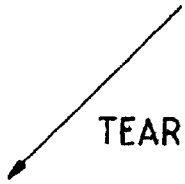
Figure 12:
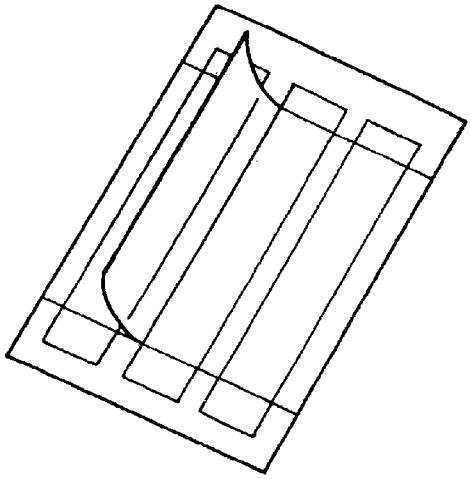
Figure 12:
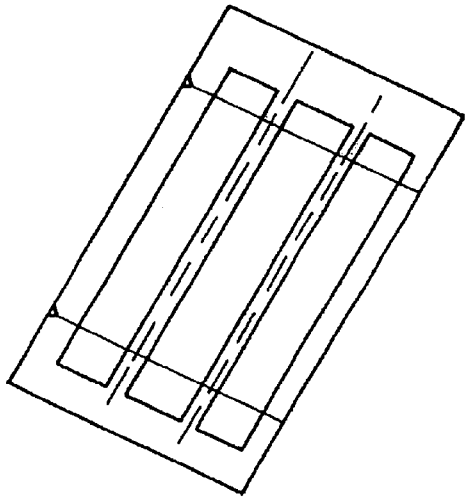
Figure 13:
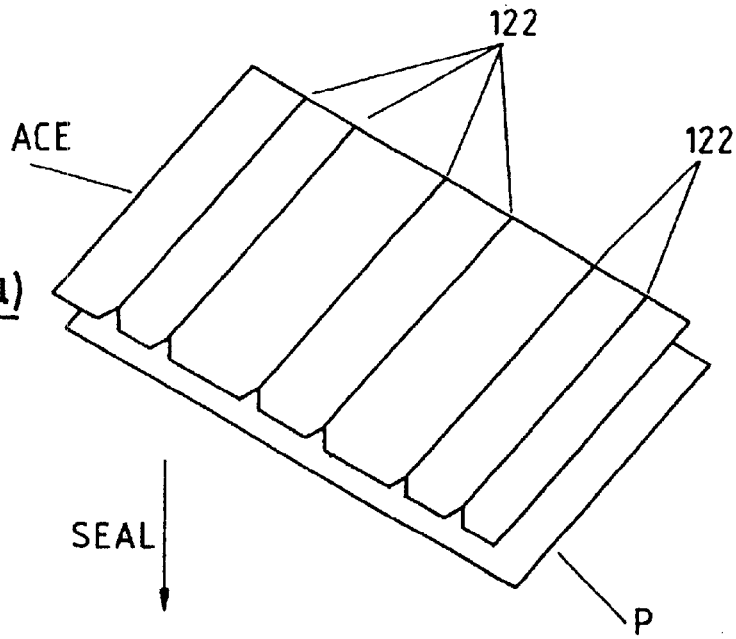
FIGS. 13*a* and *b* illustrate a bag or package constructed in accordance with a tenth pretested embodiment of the present invention.
FIGS. 13*c* illustrates a package constructed in accordance with an eleventh preferred embodiment of the present invention.
Figure 13:
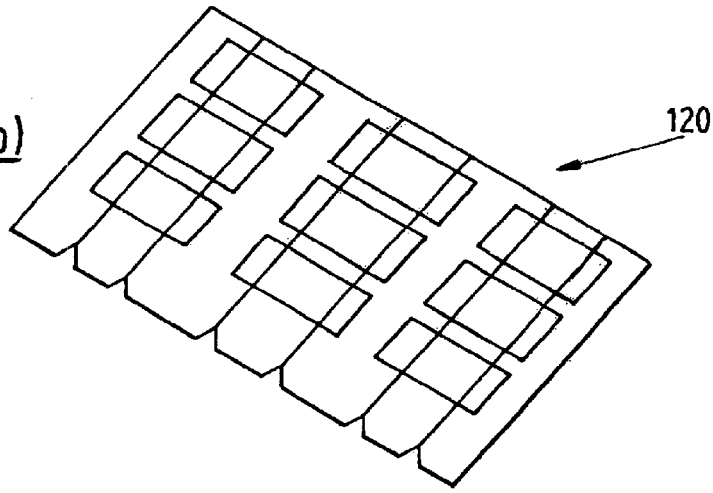
Figure 13:
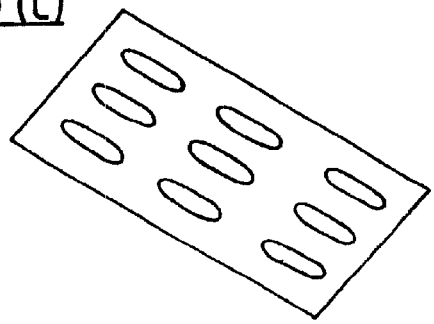

FIGS. 12(*a*)–12(*d*) illustrate a ninth preferred embodiment of the present invention. The bag 100 is produced from two sheets of material as illustrated in FIG. 12*a*. The first sheet may comprise ACE laminate of the kind shown in FIG. 6. The inner layer C includes three pieces 102, 104 arranged so that their adjacent edges extend across the ACE sheet. The adjacent edges of the sheets 102, 104 are substantially in abutment and create two spaced lines of weakness 106. The three pieces making up the inner layer C includes two strips 102 at either end of the sheet and an intermediate piece 104 which is holographic.

The ACE sheet is aligned with a sheet of polythene P of the same size and these two sheets are sealed together around the external periphery and also internally, to form three spaced compartments 108 extending in the lengthwise direction of the bag 100.

As illustrated in FIG. 12*b*, nicks 110 disposed at or adjacent the lines of weakness 106 facilitate tearing of the ACE sheet to separate a middle portion of the sheet from the remainder of the bag 100. The compartments 108 are thus opened in series as the middle portion is separated and the bag is torn along the lines of weakness 106. As before, by the incorporation of perforations along the internal partitions, the tearing action be retarded to enable the compartments 108 to be opened one by one. (See FIG. 12*d*).

FIGS. 13*a* and *b* illustrate a tenth embodiment of the present invention. The bag formed 120 is similar in principal to the bag 100 shown in FIG. 12, except that there are nine compartments arranged in a three by three grid array. Additionally, the ACE sheet has six parallel lines of weakness 122, adjacent pairs of which extend across three aligned compartments as illustrated in FIG. 13*b*.

As an alternative to using a sheet of polythene P as the backing sheet as per FIG. 13*a*, a preformed blister sheet can be used as illustrated in FIG. 13*c*. Such an embodiment of the invention may have application in the pharmaceutical industry.

Figure 14:
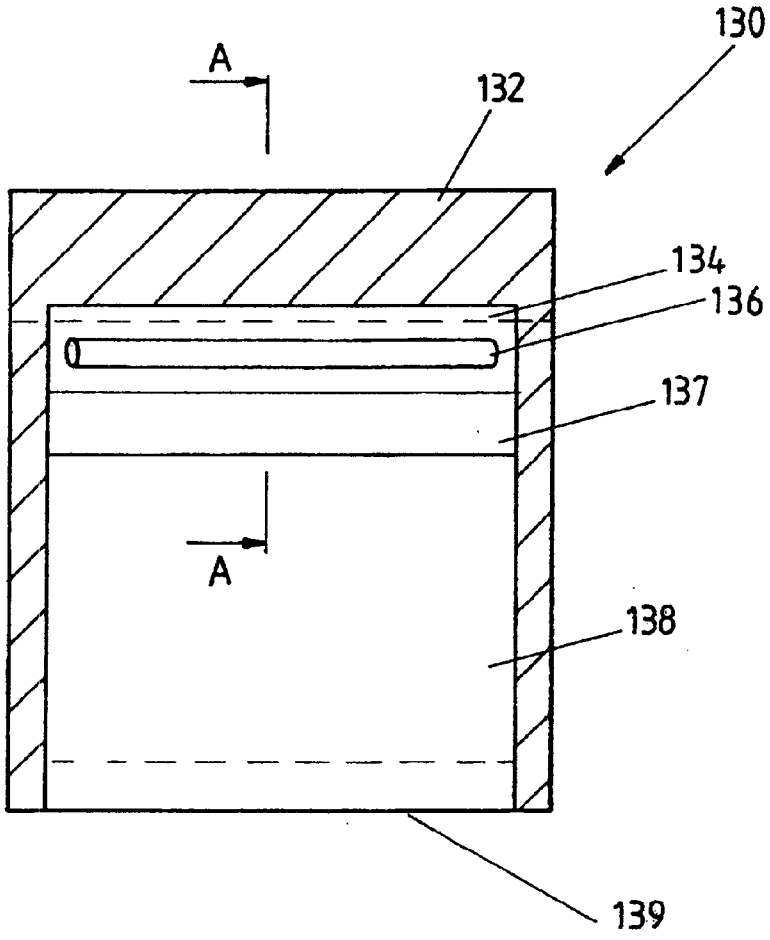
FIGS. 14(*a*)–14(*b*) illustrate a bag or package constructed in accordance with a twelfth preferred embodiment of the present invention.
Figure 14:
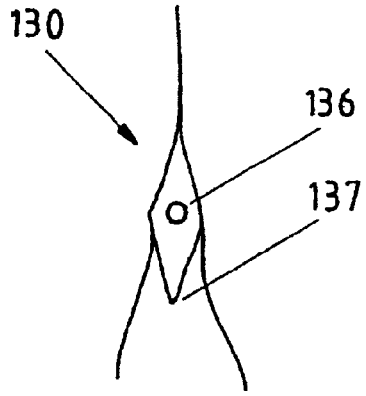

A twelfth embodiment is illustrated in FIGS. 14(*a*)–14(*b*). In this embodiment a bag 130 is formed by two overlapping and aligned sheets. A gusset portion 139 is provided in the base of the bag and the sheets and the gusset portion are sealed together. The sheets of the bag are also sealed together at a top portion 132 of the bag 130.

Additionally, a gusset portion 137 is provided intermediate the ends of the bag 130 and extending across the bag 130 substantially parallel to the tearing line 134. The space between the top sealed portions 132 and the gusset portion 137 defines an internal compartment in which a drinking straw 136 is located As the tearing line 134 extends along the internal compartment in which the drinking straw 136 is located, tearing along the tearing line 134 will open this compartment so that the drinking straw 136 will be accessible to the user.

FIG. 14*b* is a partial sectional view of the bag 130 shown in FIG. 14*a*. Once the straw is removed from the opened compartment, the straw 136 can be used by the user to puncture through the gusset portion 137 to reach the second sealed compartment containing the contents 138. The material of the gusset portion should be such that it can be punctured by the straw.

Figure 15:
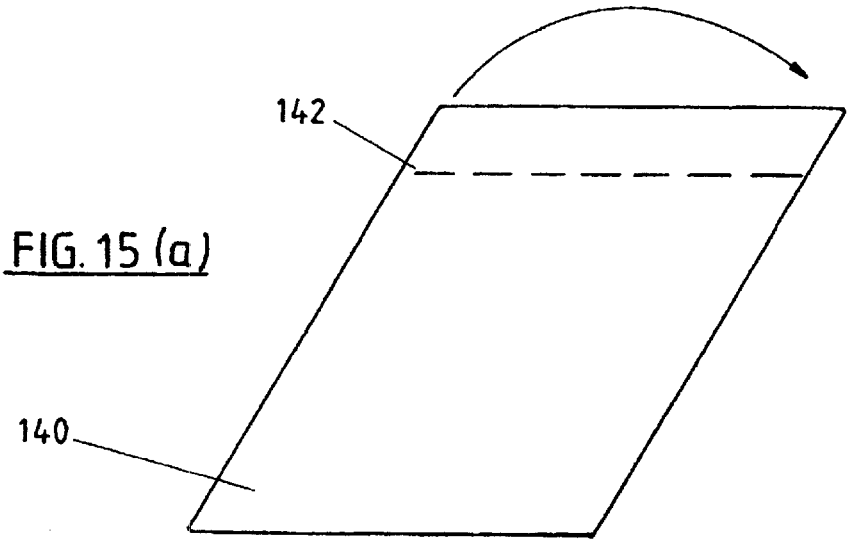
FIGS. 15(*a*)–15(*c*) illustrate a modified bag construction in accordance with the present invention.
Figure 15:
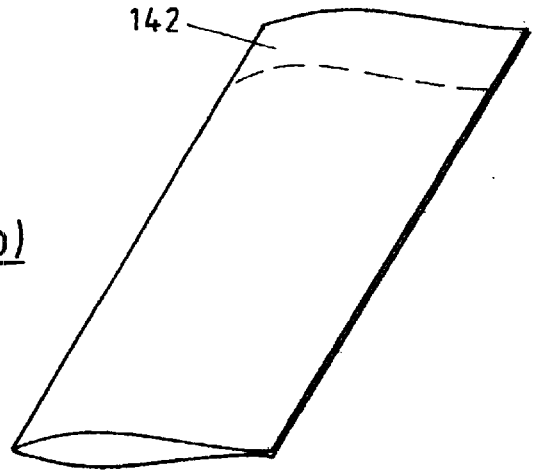
Figure 15:
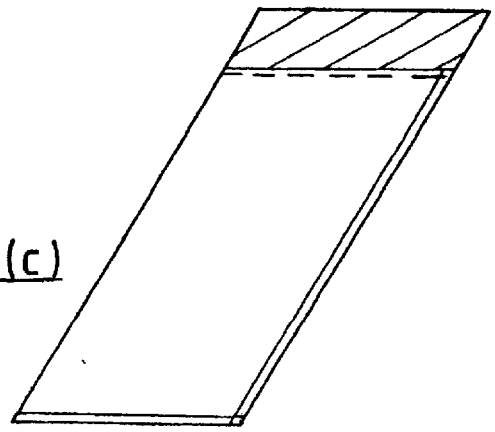
Figure 16A:
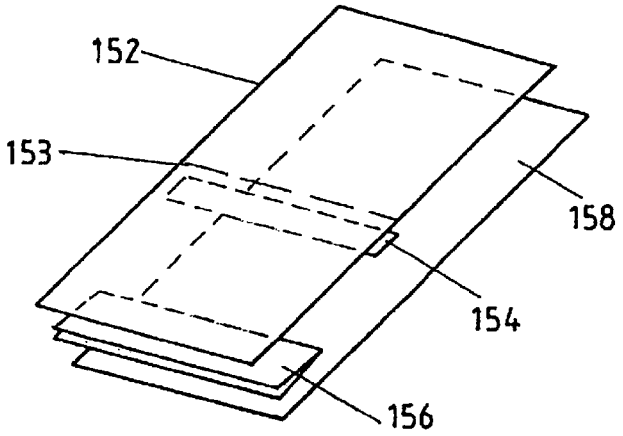
FIGS. 16(*a*)–16(*d*) illustrate a bag or package constructed in accordance with a thirteenth preferred embodiment of the present invention.
Figure 16B:
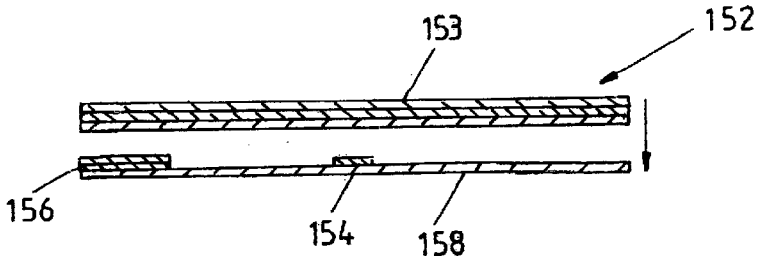
Figure 16C:
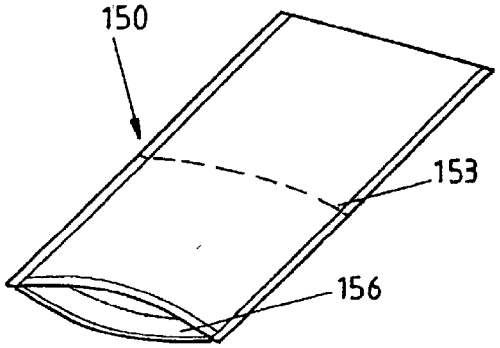
Figure 16D:
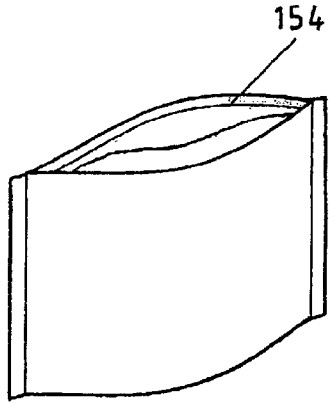

FIGS. 16(*a*)–16(*b*) illustrate a further preferred embodiment. The bag 150 includes a first sheet 152 of ACE laminate material having a line of weakness 153 extending across the bag approximately half-way down the length of the bag as illustrated in FIG. 16*a*. Additionally, the bag 150 includes a strip 154 of flexible sheet material extending lengthwise across the bag. The strip 154 is spaced only a short distance from the line of weakness formed in the first sheet 152 towards the base of the bag. The bag additionally includes a gusset strip 156 located at the base of the bag. It can be seen from FIG. 16*d* that the gusset strip enables the bag to stand up when opened The first sheet 152 together with strip 154 and gusset strip 156 are sealed to a second sheet of polythene 158. The two side edges of the, first and second sheets 152, 158 are sealed together. Additionally, the base of the first and second sheets 152, 158 are sealed with respective edges of the gusset strip as shown in FIG. 16*c*. The bag 150 is thus ready for filling following which, the top edges of the bag are sealed together. To open the bag, the bag is torn along the line of weakness 153. This exposes the strip 154 which is then able to operate as a handle enabling the bag to be carried. The bag 150 may be useful for containing instant noodles since the bag can be stood once opened Each of the embodiment illustrated in FIGS. 7 to 14, 16 utilise two aligned overlapping sheets with one sheet laid directly upon the other with the empty bag adopting a flat configuration. However, the invention is not restricted in this respect since the two sheets may be connected in such a way as to provide additional folds or gussets as required Additionally, some of the aforementioned embodiments may also be constructed with a single sheet folded over on itself, as illustrated in FIG. 15. The single sheet 140 constructed of ACE laminate includes a line of weakness 142 extending across the sheet. The sheet 140 may be folded back on itself to define two sheet portions at the front and back. The sheet 140 is folded such that the line of weakness in the front portion is aligned with the line of weakness in the back portion. The bag is then sealed around the three unsealed edges and may even be sealed along the fold line. Additional sealing may be provided as per any of the embodiments shown in FIGS. 9, 10, 11, 14 and 16.

What is claimed is:

1. A bag formed of a multi-layered sheet of flexible material including an inner layer and an outer layer relative to the interior of the bag, the inner layer being comprised of two unconnected pieces with substantially abutting adjacent edges, and the outer layer being substantially intact in the area of the abutting sections of the first layer, the bag thereby exhibiting a line of weakness defined by the interface of the two pieces along which the outer layer is tearable to open the bag.

2. The bag as claimed in claim 1, wherein the line of weakness extends from a first edge of the bag to a second opposite edge of the bag.

3. The bag as claimed in claim 1, wherein the line of weakness is straight.

4. The bag as claimed in claim 1, wherein the inner and outer layers are substantially the same size.

5. The bag as claimed in claim 1, wherein the inner and outer layers are attached to each other substantially along the entire length of the line of weakness.

6. The bag as claimed in claim 5 including a heat-sealable layer a heat-sealable layer disposed inwardly of the inner layer relative to the interior of the bag, the heat sealable layer being meltable at a temperature lower than the melting temperature of the inner layer.

7. The bag as claimed in claim 1, wherein the inner and outer layers are laminated together.

8. The bag as claimed in claim 1, wherein the inner layer includes three or more pieces with edges of each piece in abutment, there being lines of weakness defined at each interface between the pieces, two of said pieces spaced to define an intermediate portion separable from the bag.

9. The bag as claimed in claim 1, wherein the interior of the bag includes a main portion and a spout portion which is narrower than the main portion and extends beyond the main portion with the line of weakness extending across the spout portion.

10. The bag as claimed in claim 9, wherein the spout is sized to allow venting from the interior of the bag.

11. The bag as claimed in claim 9 wherein the bag is sealed with the spout portion closed, the bag being openable upon tearing along the line of weakness.

12. The bag as claimed in claim 1, wherein the bag is formed of two overlapping sheets, with first and second lines of weakness formed on respective ones of said sheets, the first and second lines of weakness being substantially aligned with each other.

13. The bag as claimed in claim 12, wherein, in the empty state, the two sheets lay one directly upon the other and are sealed together at or adjacent their edges.

14. The bag as claimed in claim 1, wherein each sheet includes an additional layer disposed inwardly of the inner layer.

15. The bag as claimed in claim 1, wherein one of the pieces of the inner layer comprises holographic material.

16. The bag as claimed in claim 15 wherein the piece of holographic material is configured as a strip.

17. The bag as claimed in claim 16 wherein the second piece of the inner layer comprises transparent material.

18. A multilayer packaging material comprising:

first and second attached layers; of which the first layer includes two unconnected adjacent sections, adjacent edges of the two sections being in contact with each other along a line of abutment;

the second layer is substantially intact along the line of abutment; and the abutment of the two sections of the first layer forms a line of weakness along which the sheet can be torn.

19. The packaging material as claimed in claim 18, further including an additional layer over the first layer.

20. The packaging material as claimed in claim 18, wherein the first and second layers are laminated together.

21. The packaging material as claimed in claim 18, wherein the material is formed into a sheet and the line of weakness extends from a first edge of the sheet to a second opposite edge of the sheet.

22. The packaging material as claimed in claim 18, wherein the line of weakness is straight.

23. The packaging material as claimed in claim 21 wherein the first and second layers are substantially the same size.

24. The packaging material as claimed in claim 18, wherein the first layer includes three or more pieces with edges of adjacent pieces being substantially in abutment, there being lines of weakness defined at each interface between the pieces, two of which are spaced to define an intermediate portion separable from the material.

25. The material as claimed in claim 18, wherein one section of the first layer comprises holographic material.

26. The material as claimed in claim 25 wherein the holographic material is configured as a strip.

27. The material as claimed in claim 26 wherein the other section of the first layer comprises transparent material.

28. A bag comprising:

a multi-layer flexible sheet sealed at edges thereof to define an interior space, the sheet including a first layer and a second layer, the first layer being comprised of two unconnected adjacent sections attached to the second layer, adjacent edges of the two sections being in contact with each other along a line of abutment;

the second layer being substantially continuous along the line of abutment;

the abutment of the two sections of the first layer forming a line of weakness along which the sheet can be torn to open the bag.

29. The bag as claimed in claim 28, wherein continuity of the second layer along the line of abutment seals the interior of the bag in the area of the line of abutment.

30. A bag comprising two multi-layered sheets as claimed in claim 28, the two sheets being secured together at edges thereof.

31. The bag as claimed in claim 30, further including lines of weakness on each sheet that are substantially aligned with each other.

32. The bag as claimed in claim 30, further including an additional layer secured to a surface of each sheet within the interior of the bag.

33. The bag as claimed in claim 32, wherein the additional layers are heat sealed to the respective sheets at melting temperatures lower than the melting temperatures of the adjacent layers of the respective sheets.

34. The bag as claimed in claim 28, wherein the first and second layers are layers relative to the interior of the bag.

35. The bag as claimed in claim 34, wherein the sheet includes an additional layer layer.

36. The bag as claimed in claim 35, wherein the additional layer is heat sealed to the first layer at a melting a temperature lower than the melting temperature of the first layer.

37. The bag as claimed in claim 28, wherein the line of weakness extends from a first edge of the bag to a second opposite edge of the bag.

38. The bag as claimed in claim 28, wherein the line of weakness is straight.

39. The bag as claimed in claim 28, wherein the first and second layers are substantially the same size.

40. The bag as claimed in claim 28, wherein the first and second layers are attached to each other substantially along the entire length of the line of weakness.

41. The bag as claimed in claim 28, wherein the first layer includes three unconnected sections with edges of each section in abutment, and two lines of weakness respectively defined at the interface between the sections, the lines of weakness being spaced to define an intermediate portion separable from the bag.

42. The bag as claimed in claim 41, wherein:

the interior of the bag includes a main portion and a spout portion which is narrower than the main portion and which extends beyond the main portion;

a first one of the lines of weakness extends across the spout portion;

the bag is sealed with the, spout portion closed, the spout is openable by tearing along the first line of weakness; and the spout is removable by tearing along the second line of weakness.

43. The bag as claimed in claim 28, wherein:

the interior of the bag includes a main portion and a spout portion which is narrower than the main portion and which extends beyond the main portion; and the line of weakness extends across the spout portion.

44. The bag as claimed in claim 28, wherein one of the sections of the first layer comprises holographic material.

45. The bag as claimed in claim 44 wherein the holographic material is configured as a strip.

46. The bag as claimed in claim 45 wherein the other section of the first layer comprises transparent material.

47. A food storage bag suitable for use in a microwave oven comprising:

a multi-layer flexible sheet sealed at edges thereof to define a main interior space for food storage and a communicating spout which is narrower than the main interior space, the sheet including a first layer and a second layer, the first layer being comprised of first and second sections attached to the second layer, an edge of the first section being in contact with a first edge of the second section along a first line of abutment which extends across the spout;

the second layer being substantially continuous along the first line of abutment;

the abutment of the first and second sections of the first layer forming a first line of weakness along which the sheet is tearable to open the spout;

the first layer being further comprised of a third section attached to the second layer, an edge of the third section being in contact with a second edge of the second section along a second line of abutment which extends across the main interior space;

the second layer being substantially continuous along the second line of abutment;

the abutment of the second and third sections of the first layer forming a second line of weakness along which the sheet is tearable to open the main interior space and to remove the spout;

whereby the spout may be opened to permit venting of the interior of the bag by tearing along the first line of weakness, and the spout maybe removed, and the main interior space opened to permit removal of the contents after cooking by tearing along the second line of weakness.

48. The bag as claimed in claim 47, wherein continuity of the second layer along the first and second lines of abutment seals the interior of the bag in the areas of the respective lines of abutment.

49. A bag comprising two multi-layered sheets as claimed in claim 47, the two sheets being secured together at edges thereof.

50. The bag as claimed in claim 49, wherein lines of weakness on each sheet are substantially aligned with each other.

51. The bag as claimed in claim 49, further including an additional layer secured to a surface of each sheet within the interior of the bag.

52. The bag as claimed in claim 51, wherein the additional layers are heat sealed to the respective sheets at melting temperatures lower than the melting temperatures of the adjacent layers of the respective sheets.

53. The bag as claimed in claim 47, wherein the first and second layers are respectively, the inner and outer layers relative to the interior of the bag.

54. The bag as claimed in claim 53, wherein the sheet includes an additional layer disposed inwardly of the first layer.

55. The bag as claimed in claim 54, wherein the additional layer is heat sealed to the first layer at a melting a temperature lower than the melting temperature of the first layer.

56. The bag as claimed in claim 47, wherein the line of weakness is straight.

57. The bag as claimed in claim 47, wherein one of the sections of the first layer comprises holographic material.

58. The bag as claimed in claim 57, wherein the holographic material is configured as a strip.

59. The bag as claimed in claim 58, wherein the other section of the first layer comprises transparent material.

60. The bag as claimed in claim 47, wherein the abutting sections of the first layer are not connected to each other at the line of abutment.

* * * * *

UNITED STATES PATENT AND TRADEMARK OFFICE

CERTIFICATE OF CORRECTION

PATENT NO. : 6,610,338 B2
DATED : August 26, 2003
INVENTOR(S) : Luen Sing Tang

It is certified that error appears in the above-identified patent and that said Letters Patent is hereby corrected as shown below:

Title page,
Item [73], Assignee, should read:
-- Tecksom International Limited (BS) --

Signed and Sealed this

Twentieth Day of January, 2004

JON W. DUDAS
*Acting Director of the United States Patent and Trademark Office*